United States Patent [19]

Lowe et al.

[11] Patent Number: 5,046,097

[45] Date of Patent: Sep. 3, 1991

[54] SOUND IMAGING PROCESS

[75] Inventors: Danny D. Lowe; John W. Lees, both of Los Angeles, Calif.

[73] Assignee: QSound Ltd., Calgary, Canada

[21] Appl. No.: 239,981

[22] Filed: Sep. 2, 1988

[51] Int. Cl.[5] ..... H04S 5/00

[52] U.S. Cl. ..... 381/17

[58] Field of Search ..... 381/1, 17, 26

[56] References Cited

U.S. PATENT DOCUMENTS

| | | | |
|---|---|---|---|
| 4,063,034 | 12/1977 | Peters | 381/17 |
| 4,706,287 | 11/1987 | Blackmer et al. | 381/17 |
| 4,792,974 | 12/1988 | Chare | 381/17 |
| 4,817,149 | 3/1989 | Myers | 381/1 |

FOREIGN PATENT DOCUMENTS

| | | | |
|---|---|---|---|
| 1512059 | 2/1968 | France | 381/17 |
| 942459 | 11/1963 | United Kingdom | 381/17 |

OTHER PUBLICATIONS

Chamberlin, Musical Application of Microprocessors, 1980, pp. 447-452.

*Primary Examiner*—Forester W. Isen

*Attorney, Agent, or Firm*—Lewis H. Eslinger; Jay H. Maioli

[57] ABSTRACT

A process is described to produce the illusion of distinct sound sources distributed throughout the three-dimensional space containing the listener, using conventional stereo playback equipment. The present process places an apparent image of the assumed sound source in a predetermined and highly localized position. A plurality of such processed signals corresponding to different sources and positions may be mixed using conventional techniques without disturbing the positions of the individual images. Monophonic signals, each representing an assumed sound source, are processed to produce left and right stereo signals. Resulting stereo signals may be reproduced by two loudspeakers, directly or via conventional recording and replay techniques. A listener perceives a realistic image of each source at its respective position as predetermined by the process. Images above and below the loudspeakers, to left and right of the extreme loudspeaker positions, between the listener and the loudspeakers or beyond the loudspeakers, or even behind a listener facing the loudspeakers, may be achieved.

2 Claims, 15 Drawing Sheets

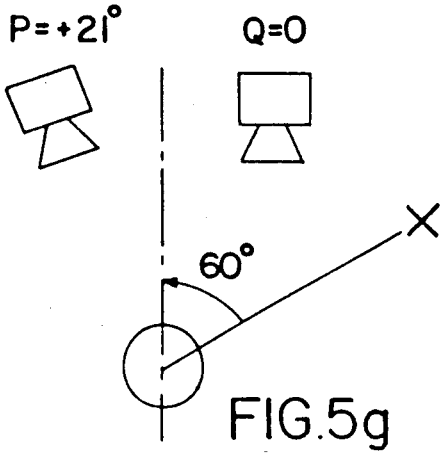
FIG.5g
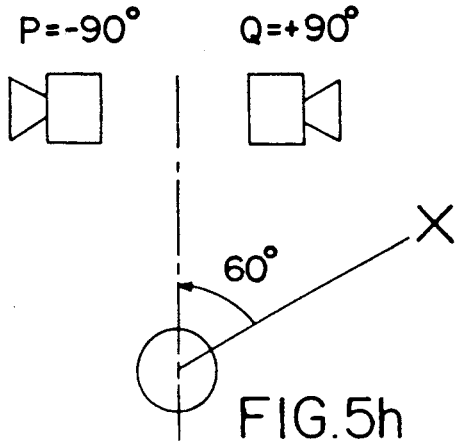
FIG.5h
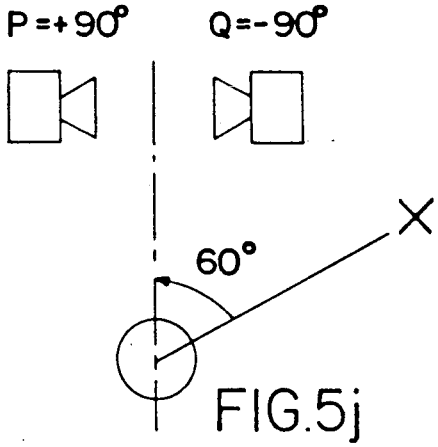
FIG.5j
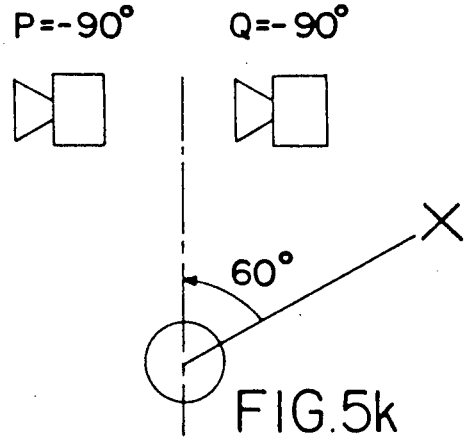
FIG.5k
| ROOM NUMBER | s | d |
|---|---|---|
| 1 | 1.0 | 1.4 |
| 2 | 1.8 | 2.5 |
| 3 | 1.8 | 2.4 |
FIG.5m

| SIGNAL | | LEFT CHANNEL | | RIGHT CHANNEL | | | IMAGE POSITION | |
|---|---|---|---|---|---|---|---|---|
| FREQ Hz | INTERVAL s | AMPLITUDE V | DELAY µs | AMPLITUDE V | DELAY µs | INVERSION +/- | AZIMUTH(a) DEGREES | ALTITUDE(b) DEGREES |
| 500 | 0.9 | 3.26 | 1250 | 3.77 | 160 | + | -52 | 5 |
| 750 | 0.9 | 3.26 | 950 | 3.33 | 160 | + | -52 | 5 |
| 1000 | 0.9 | 3.26 | 780 | 3.70 | 160 | + | -52 | 5 |
| 500 | 0.9 | 3.26 | 326 | 3.94 | 160 | - | -83 | 5 |
| 750 | 0.9 | 3.26 | 375 | 3.33 | 160 | - | -83 | 5 |
| 1000 | 0.9 | 3.26 | 375 | 3.26 | 160 | - | -83 | 5 |
| 6600 | 4.5 | 3.19 | 226 | 3.19 | 160 | - | -8 | 28 |
| 6800 | 4.5 | 3.19 | 229 | 3.19 | 160 | - | -8 | 28 |

FIG. 15

SOUND IMAGING PROCESS

FIELD OF THE INVENTION

This invention relates to the transmission, recording and reproduction of sound and is more particularly directed to systems for recording and reproducing speech, music and other sound effects. It is applicable in particular, although not exclusively, to systems associated with picture effects as in motion pictures and television.

BACKGROUND OF THE INVENTION

Human listeners are readily able to estimate the direction and range of a sound source. This ability is remarkable in many respects. A human being has only two ears, and is thus apparently sensing with only two degrees of freedom. To locate a sound in three-dimensional space requires three degrees of freedom, for example azimuth angle, altitude angle, and range. In translating from two to three degrees of freedom we would expect on theoretical grounds that ambiguities would commonly arise, but such ambiguities are rarely experienced. When multiple sound sources are distributed in space around the listener, the position of each may be perceived independently and simultaneously. This is true even when the sources are of a generally similar nature, as for example in a crowd of people all speaking at once, at a cocktail party. Despite substantial and continuing research work over many years, no satisfactory theory has yet been developed to account for all of the perceptual abilities of the average listener.

A process which measures the pressure or velocity of a sound wave at a single point, and reproduces that sound effectively at a single point, preserves the intelligibility of speech and much of the identity (and pleasure) of music. Such a system removes all of the information needed to locate the sound in space; thus an orchestra, reproduced by such a system, is perceived as if all instruments were playing at the single point of reproduction. Early in the history of sound reproduction it became clear that such a system removed a substantial part of the pleasure of listening. Exercising the ability to perceive the location, as well as the nature, of a sound source is pleasurable to the listener.

Efforts were therefore directed to preserving the directional cues during transmission and reproduction. In the continuing lack of a satisfactory theory to elucidate the nature of such cues, these efforts were perforce empirical. It seemed reasonable to assume that, since sensing with two ears is vital to perception of sound location, two transmission channels should be provided. In U.S. Pat. No. 2,093,540, issued to Alan D. Blumlein in September 1937 (and filed in 1932), substantial detail for such a system is given. This landmark patent covers methods in use today for optical stereo soundtracks on motion picture film, stereo recording on phonograph discs, stereo microphone techniques, and stereo loudspeaker placement. The artificial emphasis of the difference between the stereo channels as a means of broadening the stereo image, which is the basis of many present stereo sound enhancement techniques, is described in detail. The basic acoustical relationships required to place a stereo sound image in coincidence with a visual image, across the lateral dimension of a motion picture film, are shown in considerable mathematical detail.

From the nineteen-thirties to the present day continual improvement and refinement has been applied to the basic stereo system exemplified in Blumlein's work. For example, in U.S. Pat. No. 4,118,599, issued to Makoto Iwahara et al in October 1978, great efforts are made to ensure that the sound pressures at the ears of a single listener, critically placed and oriented with respect to the loudspeakers, ". . . faithfully represent what a person actually located in the position of the microphone would hear . . ." (Col. 3 lines 4–6). Similarly in U.S. Pat. No. 4,524,451, issued to Koji Watanabe in June 1985, we see analysis founded on a similar concern; "If the front speakers are driven by signals which would produce the same sound pressures at the listener's ears as . . ." (Col. 6 lines 42–44). Such systems do not seem to have come into widespread use, despite their obvious potential for accuracy; possibly this is because the analysis on which they are based is critically dependent on the position, angle and dimensions of the listener's head.

It would appear that this concern for accurate, detailed reproduction of the spatial cues present when a real sound source is heard first emerged from work at the Bell Telephone Laboratories, as detailed in U.S. Pat. No. 3,236,949 issued to Bishnu Atal et al in February 1966. The goal is explicitly stated; "It is in accordance with the present invention to provide at the listener's left and right ears, the appropriate sound pressure waves which would reach his ears from such a source of sound 3, from the two fixed position loudspeakers 1 and 2." (Col. 3 lines 9–13). This has clearly been the goal of many later inventors.

A different line of improvement has sought to enhance or expand the scope of the perceived stereo image, which normally lies entirely along a line joining the centres of the loudspeakers. Typical of such approaches is the work described in U.S. Pat. No. 4,355,203 issued to Joel Cohen in October 1982. This patent describes elegant modern circuitry to emphasise the difference between the left and right stereo channels, ". . . for either increasing stereo separation or enhancing perimeter sound images, or both . . ." (Col. 1 lines 14–15). Similarly, U.S. Pat. No. 4,748,669 issued to Arnold Klayman in May 1988 describes elaborate "sum and difference" signal processing circuitry which ". . . is particularly directed to a stereo enhancement system which broadens the stereo image, and provides for an increased stereo listening area . . ." (Col. 1 lines 11–13).

Several patents have been issued covering inexpensive circuitry to expand the somewhat confined stereo image created within an automobile; typical are U.S. Pat. Nos. 4,394,536 and 4,394,537 to Kenji Shima et al in July 1983, 4,329,544 to Akitoshi Yamada in May 1982 and 4,349,698 to Makoto Iwahara in September 1982. All of these patents rely on cross-coupling the stereo channels in one way or another, to emphasise the existing cues to spatial location contained in a stereo recording.

These enhancing or broadening circuits are usually more empirically based than the precision reproduction circuits. Demands on the listening configuration are relaxed. Particularly in the case of automobile installations, where the faults caused by the environment are major and the listening conditions are less critical, they have enjoyed greater popularity. Pushing such techniques perhaps to the limit, U.S. Pat. No. 3,560,656 issued to Roswell Gilbert in February 1971 shows ingenious circuitry for use with a monophonic input and stereo output in a dictating machine. The device ". . . created a sound output which gave a distinct impression of 'breadth' and reality." (Col. 3 lines 48–49). Here the goal is clearly and frankly the provision of a pleasant experience, without thought for "accuracy".

Common to all these and many other "improvements" to the basic stereo sound system is an underlying dissatisfaction with its performance. The stereo sound image is at best limited and one-dimensional, confined to a line between the loudspeakers or small extensions of that line. Much of the pleasure and excitement of being amongst the sound sources is lost. At worst, the image breaks down entirely and the sound is merely perceived as emitted by two sources, the loudspeakers.

In attacking these problems, inventors have tried systems with four independent channels (Quadrophonic sound) or with a multiplicity of loudspeakers. U.S. Pat. No. 4,410,761, issued to Willi Schickedanz in October 1983, shows a scheme for a television set with eight loudspeakers fed from two independent channels.

An alternate approach has been to attempt to produce sound images free of the constraints of conventional stereophony. Some such systems eschew entirely the pursuit of a stable, realistic image. Hence U.S. Pat. No. 4,208,546, issued to Robert Laupman in June 1980, cites as an advantage that ". . . the auditor on the medium perpendicular will obtain a position impression, which means that he will experience a variable impression of the position of the instrument or singer. This increases the unreal character of the result achieved."

Tighter control of sound images is sought by Takuyo Kogure et al. in U.S. Pat. No. 4,219,696 of August 1980. They define the normal mathematics which would allow placement of sound image anywhere in the plane containing the two loudspeakers and the listener's head, using modified stereo replay equipment with two or four loudspeakers. The system relies on accurate characterisation, matching, and electrical compensation of the complex acoustic frequency response between the signal driving the loudspeaker and the sound pressure at each ear of the listener. Perhaps because this response will vary dramatically with small changes in the position, angle or dimensions of the listener's head, no practical applications of this patent appear to be in widespread use. There is considerable variation in the characteristics of loudspeakers, even when two apparently identical units, consecutively produced on a mass production assembly line, are measured. This variation would be adequate to interfere with the accuracy of a critical system such as Kogure describes, so individual tuning to match each loudspeaker might well be necessary.

Similarly, in U.S. Pat. No. 4,524,451 issued to Koji Watanabe in June 1985, precise characterisation and compensation of complex frequency responses is shown as a basis for the creation of "phantom sound sources" lateral to or behind the listener. In this case, the use of real sound sources to replace the "phantom" ones is also detailed; this is probably a more practical scheme.

A most interesting line of development has been pursued at Northwestern University, and is reported in U.S. Pat. No. 4,731,848 issued to Gary Kendall et al in March, 1988. In this work the entire reverberant environment of a listening room is carefully and accurately modelled. Each possible echo path is simulated by a delayed signal, with filtering in the delay feedback path to simulate the more rapid absorbtion of higher frequencies in the air and the environment. For the direct path, and for each echo path, directions are individually assigned; first order simulated reflections are emphasised to mask those due to the real listening environment. Directions are assigned to signals using the method of Kogure et al, cited above; the Kogure patent is incorporated into the Kendall patent by reference for this purpose (Col. 6 lines 45–48). The Kendall reverberator may provide the most accurate known simulation for indoor environments. Presumably it will not model sounds imaged to an outdoor environment, since such an environment generally lacks reverberation. The mathematical derivation of the numerous parameters in Kendall's invention relies on intimate knowledge of the room shape, its dimensions, the listener position, and the direction in which the listener is facing.

Kendall's patent mentions the use of "pinna cues" for direction, though the schematics shown incorporate no apparent means for their insertion. The pinna is the external flap of the human ear, and it modifies incoming sound according to its direction of arrival. In an article published in the Journal of the Audio Engineering Society in September 1977 (vol. 25 no. 9 pages 560–565), P. J. Bloom reports the use of simulated pinna cues to give an impression of sound source elevation in a monophonic environment. He modified broadband signals with a narrowband notch filter, and was able to produce a variable impression of elevation by varying the centre frequency of the notch. These fascinating results could not be applied to a narrowband signal, as the notch would merely cause a level change, so that the required spectral cues would not be present in the processed signal.

It is clear that the more recent refinements of the stereo system have not produced great improvement in the systems which are presently in widespread use for entertainment. This may be because their impressive towers of acoustical theory are based on an insufficiently stable foundation. Real listeners like to sit at ease, move or turn their heads, and place their loudspeakers to suit the convenience of room layout and to fit in with other furniture. Furthermore, the stereo loudspeaker system already contains deep seated, and perhaps irremediable compromises towards convenience at the expense of accuracy. Impressive sound images are available if two microphones, placed in a dummy head, feed strictly separate signals to a pair of headphones, so that signals are never mixed between channels. Once the acoustic signals are mixed by loudspeaker reproduction, their practical re-separation may be a problem comparable with unscrambling eggs.

With the increasing sterility of approaches based on acoustic theory, and no solution in sight to the analysis of human perception, a return to the earlier empiricism seems indicated. It is noteworthy that the basis of all the approaches detailed above, and indeed many others, is the basis in the Blumlein patent cited. In making a fresh empirical departure, we remain today in the position so ably documented by Blumlein: "The operation of the ears in determining the direction of a sound source is not yet fully known but it is fairly well established that the main factors having effect are phase differences and intensity differences between the sounds reaching the two ears, the influence which each of these has depending upon the frequency of the sounds emitted." (Col. 2 lines 25–32).

SUMMARY OF THE INVENTION

The present invention is based on the purely empirical observation that stereo reproduction using two independent channels and two loudspeakers may occasionally and fleetingly produce highly localised images of great clarity in unexpected positions. Observation of this phenomenon by Lowe, under specialised conditions in a recording studio, led to his co-operation with Lees in systematically investigating the conditions required to produce the illusion. Some years of work have produced a substantial understanding of the effect, and the ability to reproduce it consistently and at will.

According to the present invention, an auditory illusion is produced which is characterised by:

1. An image of a sound source may be placed at will anywhere in the three-dimensional space surrounding the listener, except below floor level, without constraints imposed by loudspeaker positions.

2. The image is substantially undistorted to professional audio standards, is tightly localised, and is extremely realistic.

3. Multiple images, of independent sources and in independent positions, without known limit to their number, may be reproduced simultaneously using the same two channels.

4. Reproduction requires no more than two independent channels and two loudspeakers.

5. Separation distance or rotation of the loudspeakers may be varied within broad limits without destroying the illusion.

6. High quality reproducing equipment is not essential to production of the illusion.

7. A special listening environment (as for example an anechoic chamber) is not required; the illusion may be created in a normal indoor or outdoor environment.

8. Identical processed signals may be fed to a broad range of different reproducing arrangements in different acoustic environments, and yet will produce similar images.

9. The illusion is experienced essentially identically by any listener with normal binaural hearing.

10. Any listener positioned within an extended area will experience substantially the same acoustical image or illusion.

11. Rotation of the listener's head in any plane, as for example to "look at" the image, does not disturb the image.

12. The sound field producing the image does not objectively resemble the sound field due to a real sound source at the image position. It is for this reason that the localisation of the image is referred to as an illusion; it depends on intentionally deceiving the human perceptual system, rather than providing it with an accurately simulated and realistic stimulus.

13. Images may be created for simple narrowband sound sources, such as bursts of sine waves at a fixed frequency, or complicated broadband sources, such as full range recordings of voices or musical instruments, using similar methods and with similar results.

The processing of signals in accordance with the present invention, to create the illusion, is characterised by:

14. Processing of a signal to produce a localised image preferably starts from a monophonic signal bearing no inherent positional information.

15. Processing is compatible with accepted professional audio engineering equipment and techniques.

16. Processing is carried out by passing the signal through a transmission function whose amplitude and phase are in general non-uniform functions of frequency. The transmission function may involve signal inversion, and substantial frequency-dependent delay.

17. The transmission functions used in processing are not derivable from any presently known theory. They must be characterised by empirical means.

18. Each processing transmission function places an image in a single position which is determined by the characteristics of the function. Thus, position is uniquely determined by the transmission function.

19. For a given position there may exist a plurality of different transmission functions, each of which will suffice to place the image at the specified position.

Thus, the transmission function to be used is not uniquely determined by the position of the illusion to be created.

20. If a moving image is required, it may be produced by a smoothly changing transmission function. Thus a suitably flexible implementation of the process need not be confined to the production of static images.

21. Processed signals may be reproduced directly after processing, or be recorded by conventional stereo recording techniques such as optical disc, magnetic tape, or optical sound track, or transmitted by any conventional stereo transmission technique such as radio or cable, without adverse effect on the image.

22. Each recording or transmission process (and in particular each individual loudspeaker) has its own non-uniform complex transmission function. Hence an implication of the characteristics detailed in paragraphs 6, 20 and 21 above is that the transmission functions used in processing are robust, and need not be reproduced with complete accuracy.

23. No echoes or reverberant effects are introduced by the process. Hence indoor or outdoor environments for the image seem equally realistic, and reverberation may be added freely for other effects without interfering with imaging.

24. The imaging process may be applied recursively. For example, if each channel of a conventional stereo signal is treated as a monophonic signal, and the channels are imaged to two different positions in the listener's space, a complete conventional stereo image along the line joining the positions of the images of the channels will be perceived.

BRIEF DESCRIPTION OF THE DRAWINGS

FIG. 5 Sub-FIGS. 5*a*–5*k* show ten plan views of listening situations with corresponding variations in loudspeaker placement. Sub-FIG. 5*m* is a table of critical dimension for three listening rooms.

FIG. 15 tabulates data for the demonstration of the present invention.

FIG. 16 Sub

DETAILED DESCRIPTION OF THE INVENTION

The Auditory Illusion

In order to define terms which will allow an unambiguous description of the imaging phenomenon and process, FIGS. 1–4 show some dimensions and angles involved.

Figure 1:
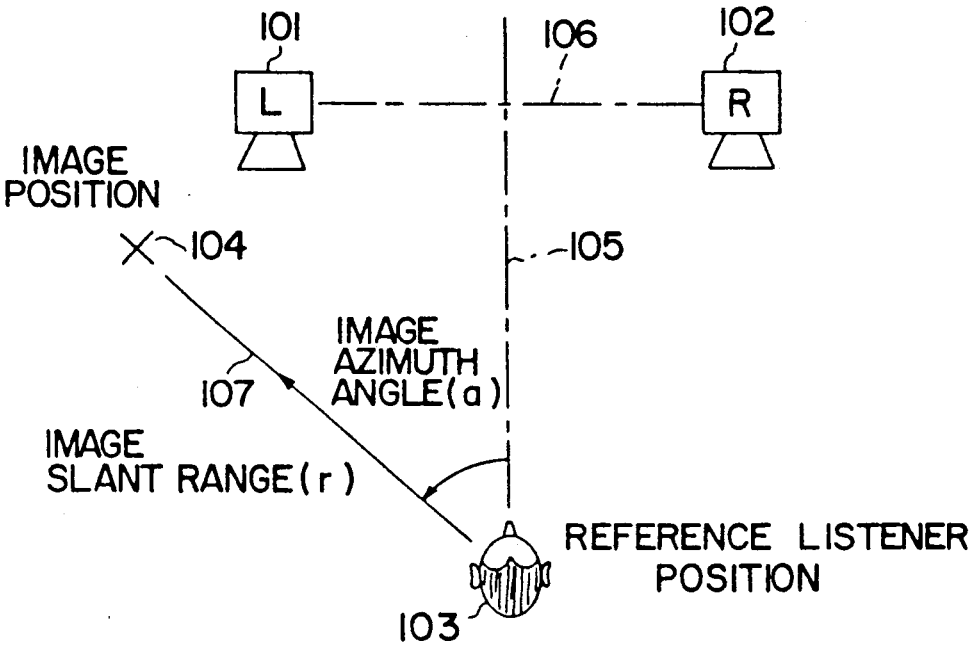
FIG. 1 is a plan view of a listening geometry to define parameters of image location.
Figure 2:
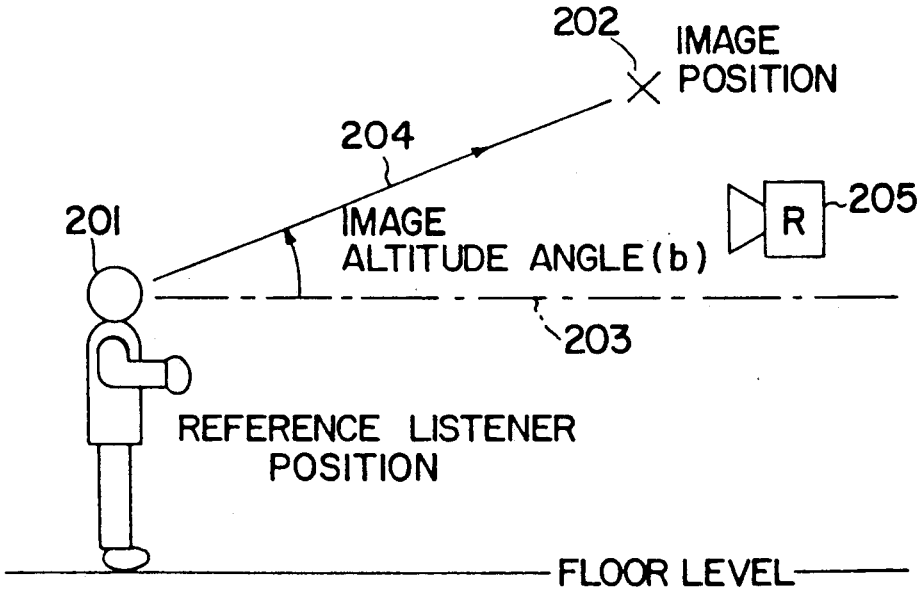
FIG. 2 is a side view corresponding to FIG. 1.

FIG. 1 is a plan view of a stereo listening situation, showing left and right loudspeakers 101 and 102 respectively, a listener 103, and a sound image position 104. For purposes of definition only, the listener is shown situated on a line 105 perpendicular to the line 106 joining the loudspeakers, and erected at the midpoint of line 106. This listener position will be referred to as the reference listener position; it should be clearly understood that the listener is not confined to this position, as in some other schemes. From the reference listener position an image azimuth angle (a) is defined as measured anticlockwise from line 105 to the line 107 joining the listener to the image position. Similarly the slant range of the image (r) is defined as the distance from the listener to the image position. This range is the true range measured in three-dimensional space, not the protected range as measured on the plan or other orthogonal view.

In prior art stereo systems no further definitions would be required, since the images are confined to the plane intersecting the loudspeakers and the head of the listener. Indeed, it has normally been assumed that the universe of discourse is planar, and this strong restriction has neither been stated nor has allowance been made for its effects. This may not be reasonable where individual acoustic responses between the ears of the listener and the loudspeakers are calculated; the four points defined by the loudspeaker and ear positions will, in practice, rarely lie in a single plane.

In the present invention the possibility arises of images substantially out of this plane. Accordingly in FIG. 2, which is a side view of the listening situation shown in FIG. 1, we define an altitude angle (b) for the image. In this figure listener position 201 corresponds with position 103 in FIG. 1, and image position 202 corresponds with image position 104 in FIG. 1. Image altitude angle (b) is defined as measured upward from a horizontal line 203 through the head of the listener to a line 204 joining the listener's head to the image position 202. It should be noted that the loudspeakers 205 do not necessarily lie on line 203. An image position may now be described with respect to a reference listener by a triplet (a,b,r) of real numbers, a and b being angles and r being a distance.

Figure 3:
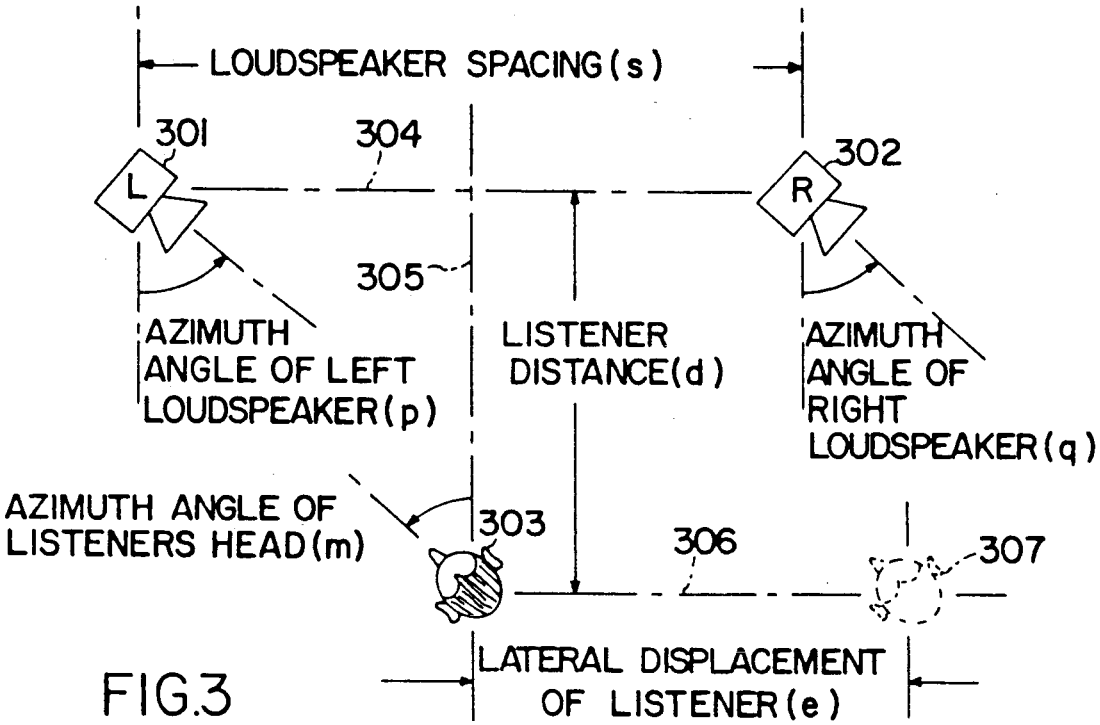
FIG. 3 is a plan view of a listening geometry to define parameters of listener location.

Having defined the image positional parameters with respect to a reference listening configuration, we proceed to define parameters for possible variations in the listening configuration. Referring to FIG. 3, we see loudspeakers 301 and 302, listener 303, and lines 304 and 305 corresponding respectively to items 101, 102, 103, 106, and 105 in FIG. 1. We define a loudspeaker spacing distance (s) measured along line 304, and a listener distance (d) measured along line 305. In the case that a listener is displaced parallel to line 304 along line 306 to position 307, we define a lateral displacement (e) measured along line 306. For each loudspeaker 301 and 302 we define respective azimuth angles (p) and (q) as measured anticlockwise from a line projected through the loudspeaker and perpendicular to the line joining the loudspeakers, in the direction toward the listener. Similarly for the listener we define an azimuth angle (m) as measured anticlockwise from line 305 to the direction in which the listener is facing.

Figure 4:
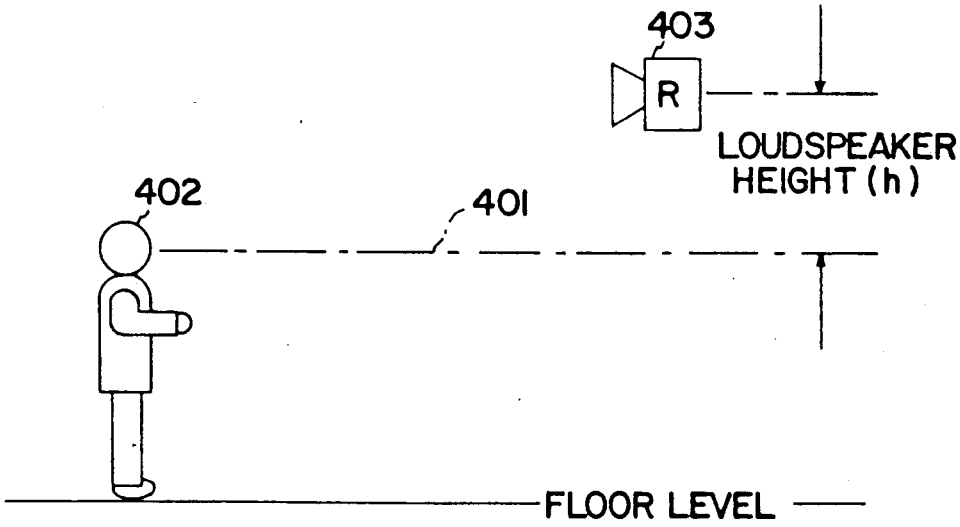
FIG. 4 is a side view corresponding to FIG. 4.
Figure 5A:
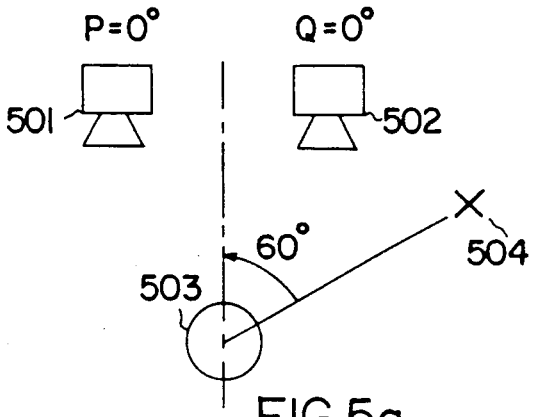
Figure 5B:
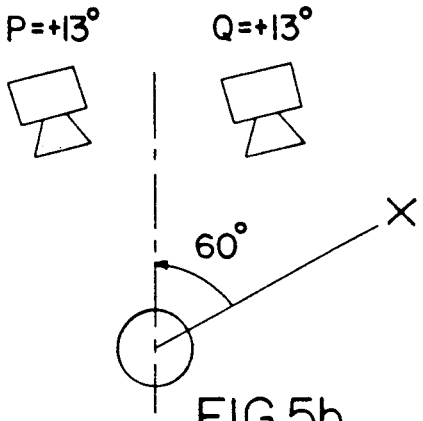
Figure 5C:
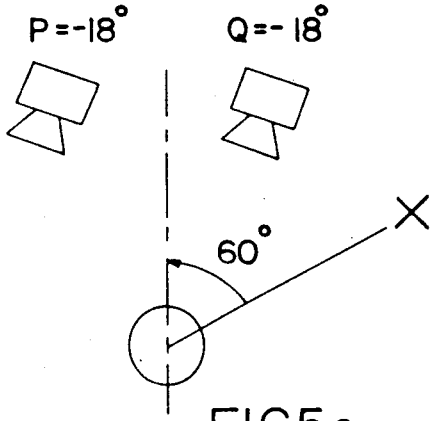
Figure 5D:
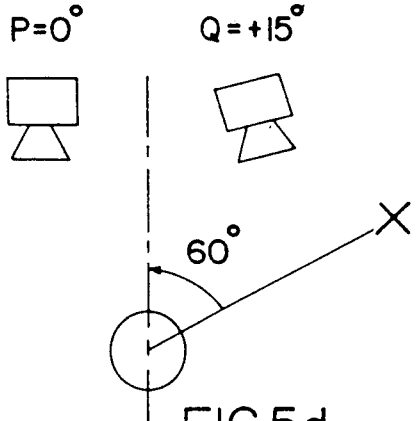
Figure 5E:
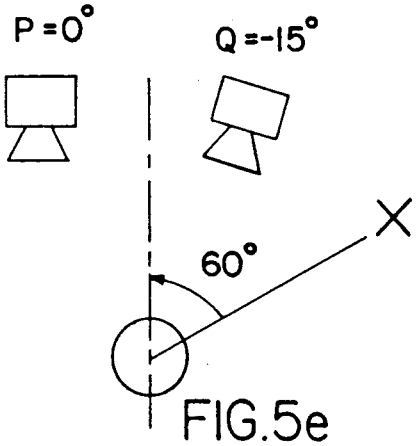
Figure 5F:
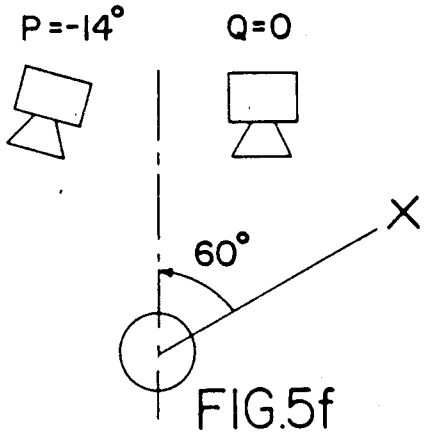

Finally, refer to FIG. 4, which is a side view of the situation shown in FIG. 3. In this figure listener 402 corresponds to 303 in FIG. 3, and loudspeaker 403 corresponds to 302 in FIG. 3. We define a loudspeaker height (h) as measured upward from the horizontal line 401 through the head of the listener 402, to the vertical centreline of the loudspeaker 403. In defining such directions of measurement it is not implied that the direction defined is the only one permissible, but that the direction defined is the positive direction. For example, in many domestic listening arrangements, furniture layout demands that the loudspeakers be below the level of the listener's head; in such a case height (h) would be negative.

These definitions do not exhaustively define all parameters of the situations shown, but they will suffice for purposes of the present discussion. The parameters as defined allow more than one description of a given geometry. For example, an image position may be described as (180,0,x) or (0,180,x) with complete equivalence. For convenience and without loss of generality we may confine all altitude angles to the range from +90 to −90 degrees, so that the first of the above descriptions would be preferred. In this document all angles will be stated in degrees.

With these definitions we may now describe in detail the properties of the auditory illusion. For clarity of exposition we will initially assume that a single image of a single source is created.

In conventional stereophonic reproduction the image is confined to lie along the line 106 in FIG. 1. Prior art stereo "image broadening" or "image enhancing" techniques normally extend the image to lie on an extension of line 106 beyond the loudspeakers, or on an extension of the azimuth arc intersecting the loudspeakers. Since the range impression in conventional stereophony is indefinite, the distinction between the line and the arc is not appreciable. In "image enhancing" systems it is rarely made clear which is intended; presumably these, too convey little impression of range.

The image produced by the present invention may be placed freely in space: azimuth angle (a) may range from 0–360 degrees, and range (r) is not restricted to distances commensurate with (s) or (d). An image may be formed very close to the listener, at a small fraction of (d), or remote at a distance several times (d), and may simultaneously be at any azimuth angle (a) without reference to the azimuth angle subtended by the loudspeakers. In addition, the present invention is capable of image placement at any altitude angle (b). Listener distance (d) may vary from 0.5 m to 30 m or beyond, with the image apparently static in space during the variation.

Good image formation has been achieved with loudspeaker spacings from 0.2 m to 8 m, using the same signals to drive the loudspeakers for all spacings. Azimuth angles at the loudspeakers (p) and (q) may be varied independently over a broad range with no effect on the image.

It is characteristic of this invention that moderate changes in loudspeaker height (h) do not affect the image altitude angle (b) perceived by the listener. This is true for both positive and negative values of (h), that is to say loudspeaker placement above or below the listener's head height. For this reason the image altitude angle is defined relative to the true horizontal rather than the loudspeaker direction. Loudspeaker height (h) becomes a free variable, unrelated to the image, which may be varied for convenience of loudspeaker installation.

Since the image formed is extremely realistic, it is natural for the listener to turn to "look at", that is to face directly toward, the image. The image remains stable as this is done; listener azimuth angle (m) has no perceptible effect on the spatial position of the image, for at least a range of angles (m) from +120 to −120 degrees. So strong is the impression of a localised sound source that listeners have no difficulty in "looking at" or pointing to the image; a group of listeners will report the same image position.

FIG. 5, which is composed of eleven sub-figures, shows a set of ten listening geometries in which image stability has been tested. Referring to sub-FIG. 5*a*, a plan view of a listening geometry is shown. Left and right loudspeakers 501 and 502 respectively reproduce sound for listener 503, producing a sound image 504. Sub-FIGS. 5*a* through 5*k* show variations in loudspeaker orientation, and are generally similar to sub-FIG. 5*a;* later sub-figures omit designations for clarity.

All ten geometries were tested in three different listening rooms with different values of loudspeaker spacing (s) and listener distance (d), as tabulated in FIG. 5*m*. Room 1 was a small studio control area containing considerable amounts of equipment, room 2 was a large recording studio almost completely empty, and room 3 was a small experimental room with sound absorbing material on three walls.

For each test the listener was asked to give the perceived image position for two conditions; listener head angle (m) zero, and head turned to face the apparent image position. Each test was repeated with three different listeners. Thus the image stability was tested in a total of 180 configurations. Each of these 180 configurations used the same input signals to the loudspeakers. In every case the image azimuth angle (a) was perceived as −60 degrees.

These tests encompass major variations in the complex acoustic transfer functions between the loudspeakers and the listener's ears. All prior art systems of stereo image formation known to the present inventors attempt, explicitly or implicitly, to reproduce at the ears of the listener the sound pressures which would be generated by a real source at the desired image position. To do this using loudspeaker reproduction, the complex acoustic transfer function between each loudspeaker and each ear of the listener must be known precisely, in order that "crosstalk" components may be compensated or cancelled. Any change in any of the four complex acoustic transfer functions will cause incomplete cancellation and impair the image; a gross change will blur, obliterate or radically change the image. The stability demonstrated above in images generated according to the present invention renders it a more attractive system for widespread use, and shows clearly that the sound field generated does not duplicate the sound pressures which a real source at the image position would generate at the listener's ears.

The image is so completely independent of the loudspeakers that the loudspeakers are not perceived as relevant in its formation. When a demonstration is carried out in a studio, where many loudspeakers distributed widely about the listener are visible, experienced listeners remain in doubt as to which pair of loudspeakers is actually in use. As distinct from conventional stereophony and other known systems, no perceptual correlate of the sound corresponds to the true sound source, the loudspeaker; accordingly, the human perceptual system, even in the face of intellectual knowledge to the contrary, dismisses the hypothesis that the loudspeaker is involved.

This inability to perceive what is known to be true is characteristic of well-formed perceptual illusions. Substantial work by professor R. L. Gregory on the measurement and characterisation of visual illusions is reported in his two books, "Eye and Brain" and "The Intelligent Eye", published by Weidenfeld and Nicolson, London in 1966 and 1970 respectively. Many experiments reported in these books confirm that the intellect cannot dispel an illusion, though it may explain one. Commercial exploitation of illusions relies entirely on their stability; the illusion of motion in a motion picture, which is well known to be merely a sequence of still pictures, and the illusion of a complete picture in television, when in fact the phosphor output decays a few scan lines behind the electron beam position, are common examples.

Figure 6:
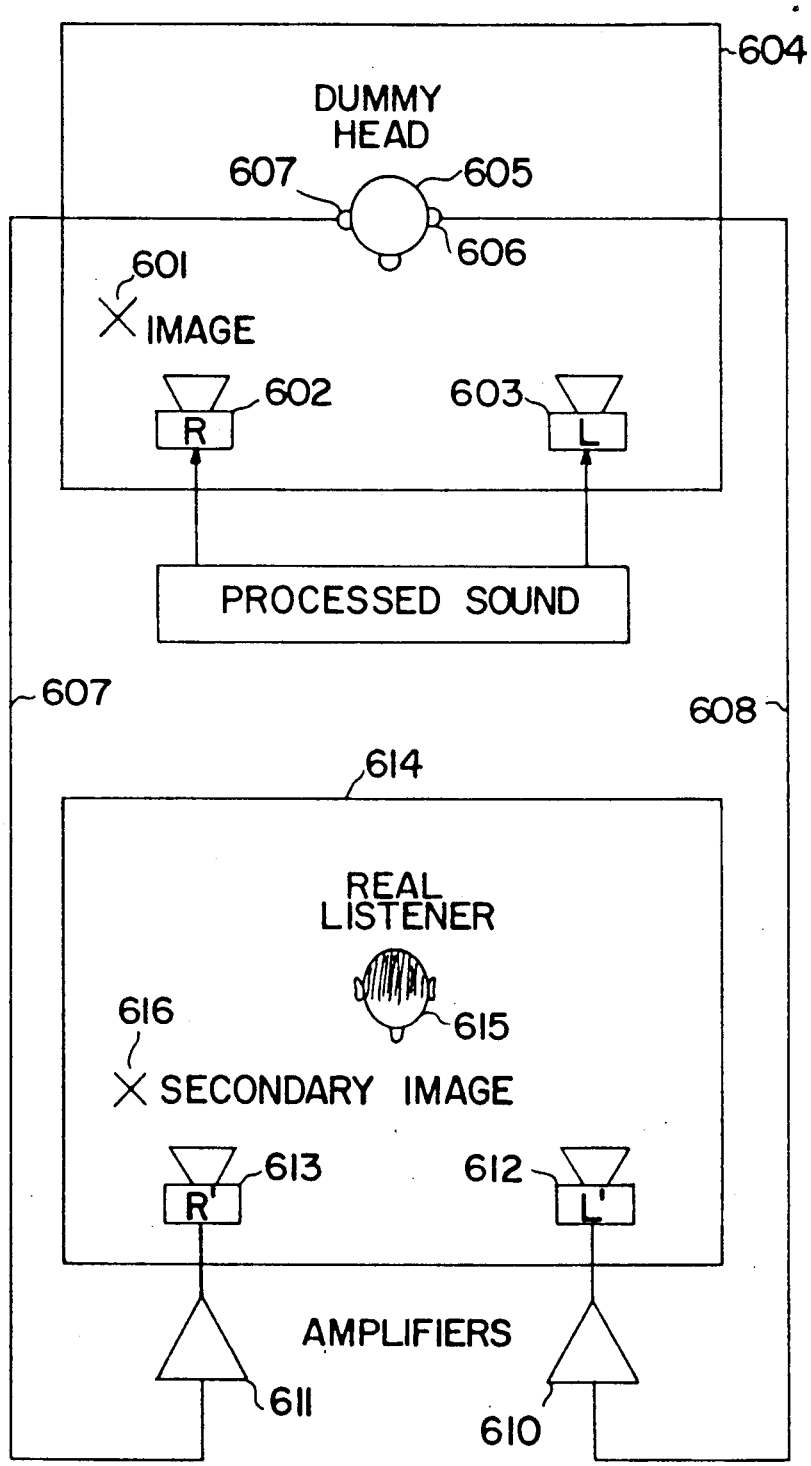
FIG. 6 shows a plan view of an image transfer experiment carried out in two isolated rooms.

Confirmation of the fact that the sound field produced does not objectively resemble that due to a real sound source at the image position is provided by the image transfer experiment shown in FIG. 6. Here a sound image 601 is formed by signals processed according to the present invention, driving loudspeakers 602 and 603 in a first room 604. A dummy head 605, such as is well known in the prior art, for instance German patent 1 927 401, carries left and right microphones 606 and 607 in its model ears. Electrical signals 608 and 609 from the respective microphones are separately amplified by amplifiers 610 and 611, which drive left and right loudspeakers 612 and 613 in a second room 614. A listener 615 situated in this second room, which is acoustically isolated from the first room, will perceive a sharp secondary image 616 corresponding to the image 601 in the first room.

If in the above situation the image 601 in the first room is replaced by a real sound source, the listener 615 in the second room will perceive no distinct image. This latter result is predicted by accepted acoustic theory. It is well documented in the prior art, for example in U.S. Pat. No. 4,388,494 issued to Peter Schöne et al in June 1983. The subject of that patent is an electrical network which may be interposed between the dummy head microphones and the reproducing loudspeakers to allow production of an image from a real sound source. We emphasise that neither such a network, nor any other form of channel cross-coupling or compensation, is used in this experiment; the microphone signals are merely separately amplified to drive the loudspeakers.

Hence the reproduction of the processed image in the above described experiment is surprising. It can be explained only if the sound field forming the image, resulting from the reproduction of signals processed according to the present invention, is objectively grossly different from the sound field generated by a real source.

In creating similar sound image illusions in a wide variety of different listening situations, using identical electrical signals to drive a variety of loudspeakers, it is found that the boundaries of the space in which the listener is situated normally form boundaries to the space in which images are perceived. If a distant image is projected in a confined space, the image will appear at the expected azimuth and altitude angles (a) and (b), but at a reduced range (r) corresponding to the true range of the wall, floor or ceiling in the image direction.

Once created, the illusion is astonishingly robust. Tape recordings containing imaged sounds may be subjected to noise reduction using the Dolby A, B, C, or SR processes with no effect on image position. These Dolby processes operate by making major spectral modifications prior to recording, and compensating them on playback. Compensation is neither accurate or complete in the Dolby process versions designed for low-cost consumer equipment. The ability to withstand these Dolby processes is important in conjunction with tape recording. Volume compression of up to 20:1 has no effect on image position; such compression is applied (usually at a less extreme ratio) in radio and television broadcasting. Limitation of bandwidth to the range 200–7000 Hz does not affect the image; such a limitation is typical of A.M. radio. A membrane may be placed over one or both loudspeakers without affecting the image; this is typical of motion picture reproduction practice.

Most surprisingly of all, a tape recording of imaged signals may be reproduced at a speed from half to double the recording speed without affecting image position. The effect on the pitch of the source in this case ranges over two full octaves; the technique is used to create special effects. This robustness shows clearly that the elevation effect is not due to the "pinna cues" reported by Bloom (cited above). In his work, perceived elevation was sensitively related to the centre frequency of a "notch" in the frequency characteristic applied to the source. If a signal treated according to Bloom were recorded, and replayed at a different speed, a major change in elevation would be perceived.

For all of the above reasons it is clear that this invention creates a novel illusion of spatially located sound images, rather than a replica of the sound field created by real sound sources. The illusion has convenient properties in terms of freedom of loudspeaker and listener placement, and is consistent between normal binaural listeners.

The Process to Produce the Illusion

Figure 7:
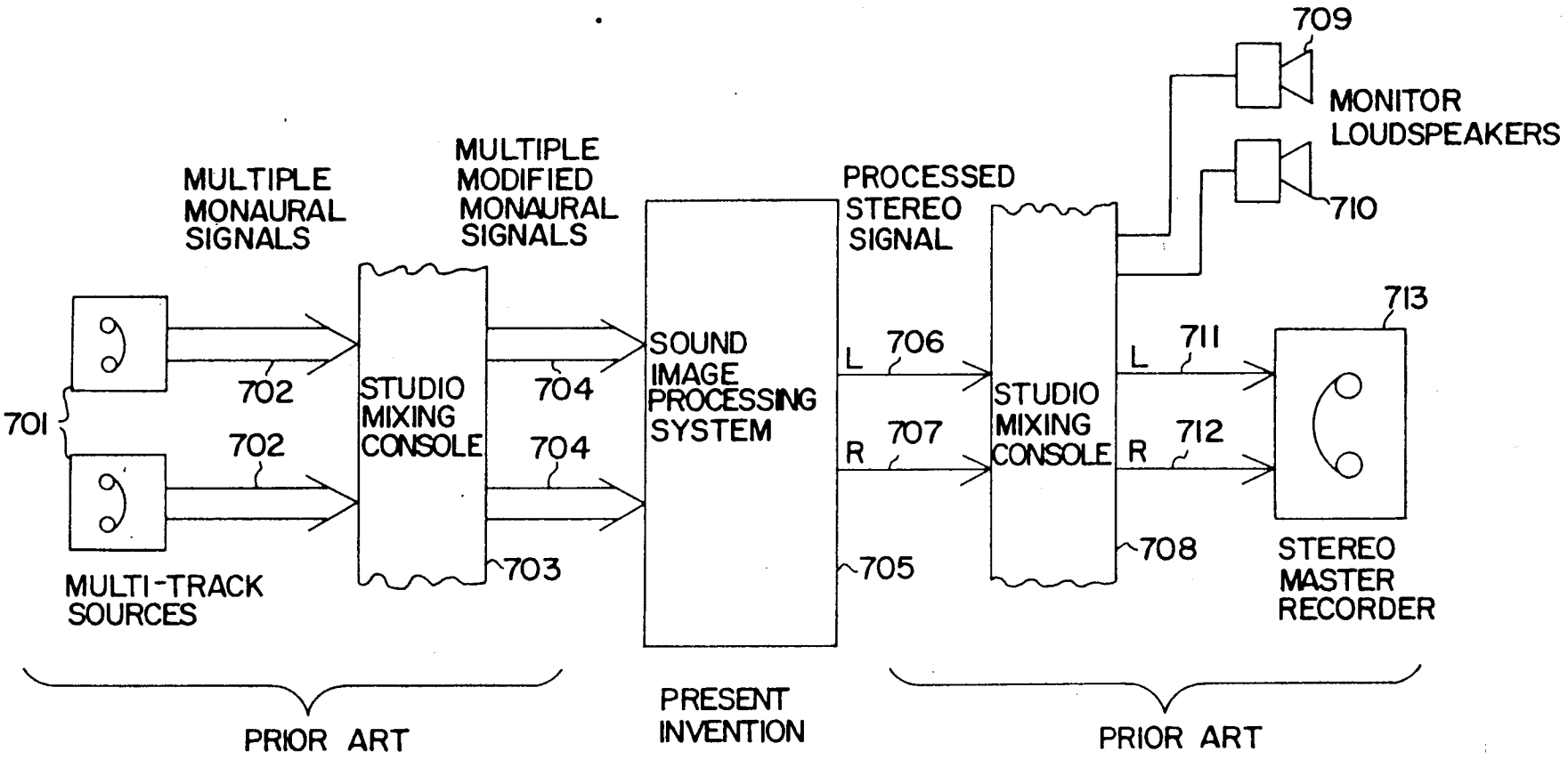
FIG. 7 is a process block diagram relating the present invention to prior art practice.

Processing of signals to generate the illusions defined above may be understood with reference to the audio postprocessing configuration shown in FIG. 7, though this is by no means limiting and operation in other configurations is both possible and desirable.

Referring to FIG. 7, one or more multi-track signal sources 701, which may be magnetic tape replay machines, feed a plurality of monophonic signals 702 derived from a plurality of sources to a studio mixing console 703. The console may be used to modify the signals, for instance by changing levels and balancing frequency content, in any desired ways All of the above is well known in the prior art.

A plurality of modified monophonic signals 704 produced by console 703 are connected to the inputs of an image processing system according to the present invention 705. Within this system each input channel is assigned to an image position, and processing is applied to produce a pair of left and right stereo signals corresponding to the imaged source. All individual channel signals are mixed to produce a final pair of left and right stereo signals 706, 707, which are returned to a mixing console 708. In practice console 703 and console 708 may be separate sections of the same console. Using console facilities, the processed signals may be applied to drive loudspeakers 709, 710 for monitoring purposes. After any required modification and level setting, master stereo signals 711 and 712 are led to master stereo recorder 713, which may be a two-channel magnello tape recorder. Items subsequent to item 705 are well known in the prior art.

When the audio postprocessing is undertaken in relation to a motion picture or television production, some means will be provided to ensure continued precise synchronism of the sound and picture. In current practice this would normally be accomplished by the provision of a time code signal which may be to the SMpTE/EBU standard and would accompany the audio signal through the process. In such a case, the time code signal would be passed through the sound image processing system 705, so that any overall audio delay introduced during processing could be taken into account by suitably delaying the time code signal. The picture may then be re-synchronised to the delayed time code, to produce exact synchronisation of the final sound and picture.

Figure 8:
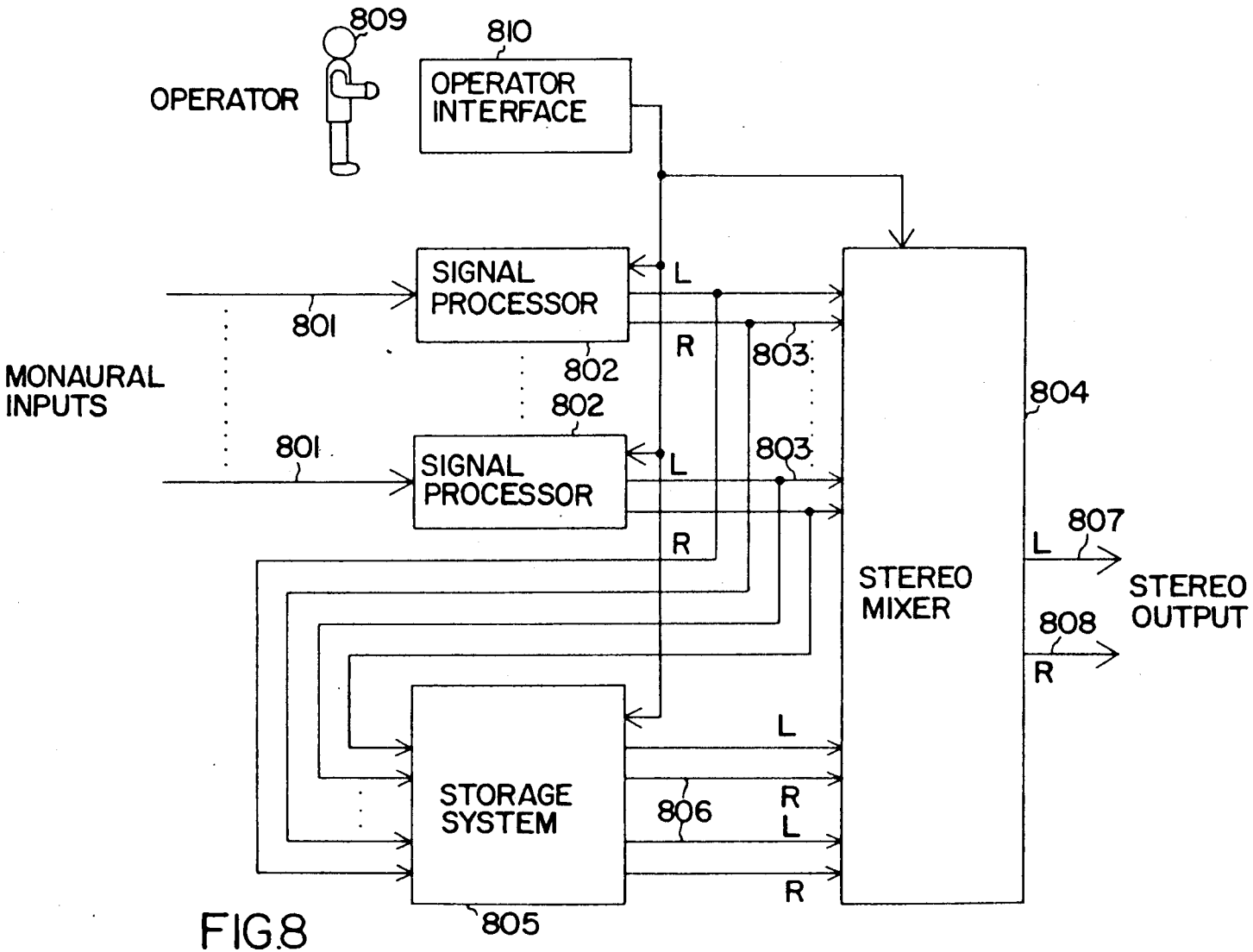
FIG. 8 is a system block diagram of the present invention.

Internal details of sound image processing system 705 are shown in FIG. 8. Here input signals 801 correspond to signals 704 in FIG. 7, and output signals 807, 808 correspond respectively to signals 711, 712 in FIG. 7. One or more monophonic input signals 801 are each led to individual signal processors 802.

These processors operate independently, with no intercoupling of audio signals. Each signal processor applies to the incoming audio signal two distinct transfer functions, producing two distinct audio output signals corresponding to left and right stereo channels. The transfer functions, which may be described in the time domain as real impulse responses or equivalently in the frequency domain as complex frequency responses or amplitude and phase responses, characterise only the desired image position to which the input signal is to be projected.

One or more processed signal pairs 803 produced by the signal processors are applied to the inputs of stereo mixer 804. Some or all of them may also be applied to the inputs of a storage system 805. This system is capable of storing complete processed stereo audio signals, and of replaying them simultaneously to appear at outputs 806. Typically this storage system may have different numbers of input channel pairs and output channel pairs. A plurality of outputs 806 from the storage system are applied to further inputs of stereo mixer 804. Stereo mixer 804 sums all left inputs to produce left output 807, and all right inputs to produce right output 808, possibly modifying the amplitude of each input before summing. No interaction or coupling of left and right channels takes place in the mixer.

A human operator 809 may control operation of the system via human interface means 810. By means of this interface the operator may specify the desired image position to be assigned to each input channel. In the case that the image is required to move, a trajectory specifying its motion as a function of time may be specified. Positions or trajectories specified will be automatically converted to corresponding complex frequency responses to be applied by the signal processors 802. Control of the storage system 805, and the mixer 804, may also be exercised via interface 810.

Many variations on this basic scheme are possible, and may be desirable. Any part of the system may be implemented in either analog or digital technology, independent of the techniques used in any other part. At the present state of the art it appears that digital techniques may be preferred throughout for stability, reliability, and flexibility. It may be particularly advantageous to implement the signal processors 802 digitally, so that no limitation need be placed on the position, trajectory, or speed of motion of an image. In such an implementation it may not always be economic to provide for signal processing to occur in real time, though such operation is entirely feasible. If real-time signal processing is not provided, outputs 803 would be led solely to storage system 805, which would be capable of slow recording and real-time replay. Conversely, if an adequate number of real-time signal processors 802 are provided, storage system 805 may be omitted In the compromise situation described above, signals would be processed in real time in batches, and stored in storage system 805 prior to final assembly of a complete set of imaged signals. Stereo mixing facilities may be provided as part of the studio console, in which case mixer 804 may be omitted and all stereo out puts 803 and 806 led directly to the console. In applications where fixed, preset image positions are adequate no operator 809 is required, and operator interface 810 may be omitted. These variations may be provided in any combination as circumstances dictate.

Figure 9:
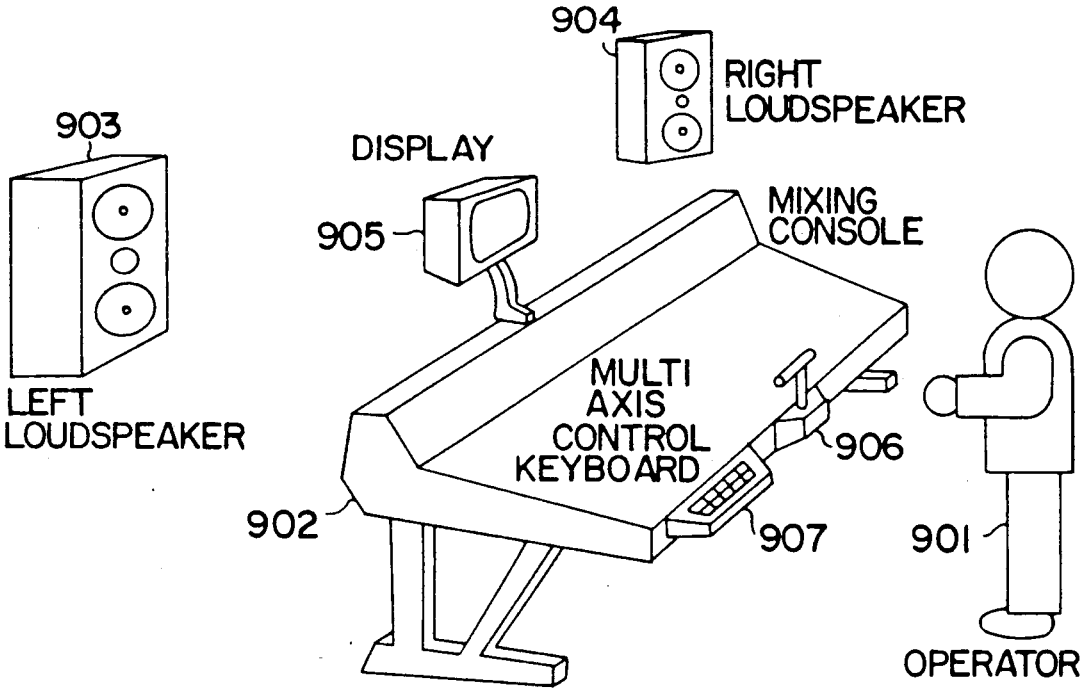
FIG. 9 shows a pictorial perspective view of an operator workstation layout for definition of the human interface of the present invention.

An overview of the human interface is provided by pictorial FIG. 9. Operator 901 controls mixing console 902, equipped with left and right stereo monitor loudspeakers 903, 904. Although stability of the final processed image is good to a loudspeaker spacing (s) as low as 0.2 m, it is advisable for the mixing operator to be provided with loudspeakers placed at least 0.5 m apart. With such spacing, accurate image placement is more readily achieved. The task of placement, particularly if accuracy is at issue as when sound is matched to a picture, is more exacting than the task of listening. This type of operator workstation is familiar prior art in professional audio engineering.

For purposes of this invention, a computer graphic display means 905, a multi-axis control 906, and a keyboard 907 may be added, along with suitable computing and storage facilities to support them. These latter facilities are not illustrated in the figure, as they are preferably remotely mounted to avoid cluttering the operator's workspace. Sound image positions are preferably controllable on a real-time basis using the multi-axis control 906, and monitored using loudspeakers 903, 904, which will reproduce the specified audio effect essentially instantaneously.

Computer graphic display means 905 may provide a graphic representation of the position or trajectory of the image in space. It will be used as an aid in planning and to recall the spatial effects applied to channels, including channels other than the current one. Editing, timing and other control information may be entered using keyboard 907, with visual feedback presented on display means 905.

Figure 10:
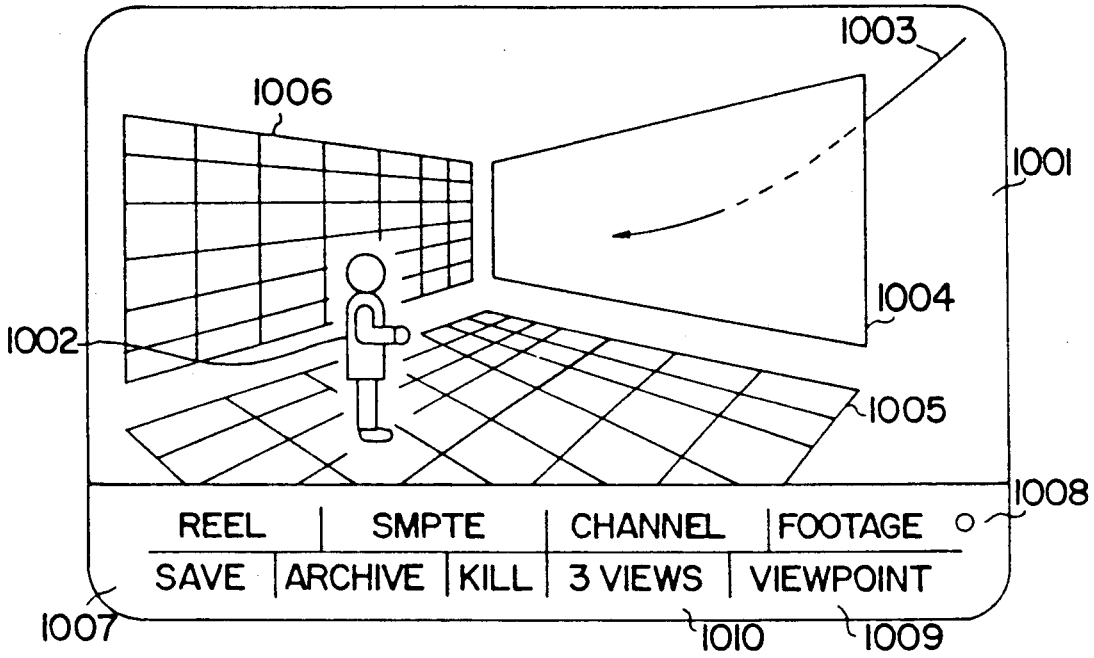
FIG. 10 depicts a computer-graphic perspective display used in controlling the present invention.
Figure 11:
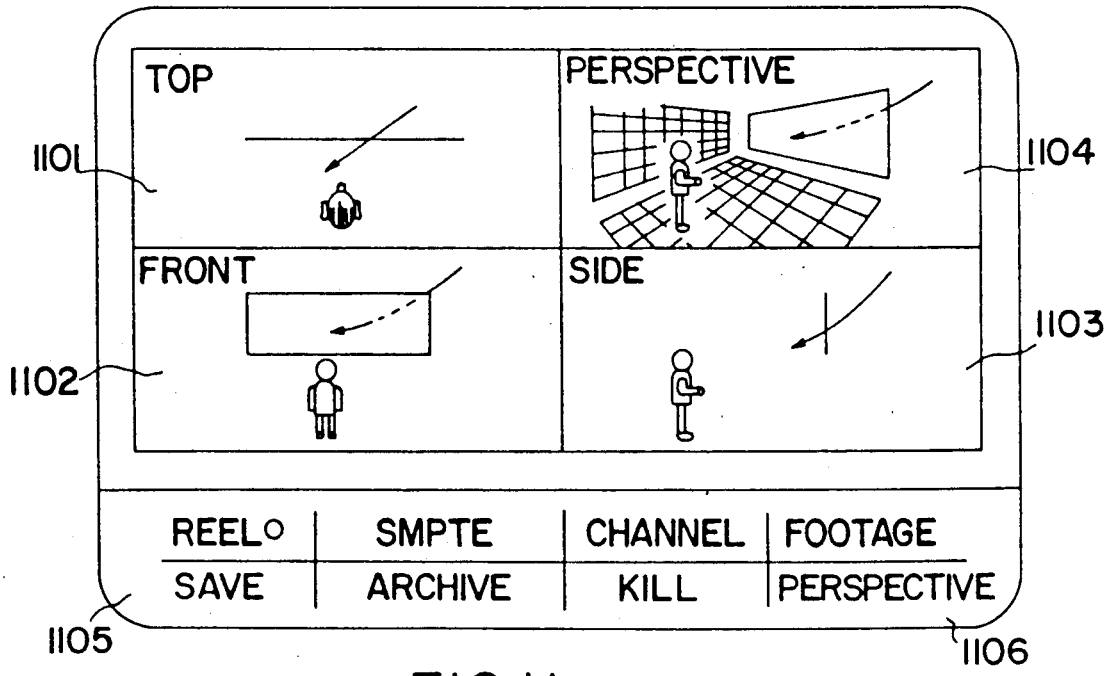
FIG. 11 depicts a computer-graphic display of three orthogonal views used in controlling the present invention.

Two displays which may be presented on computer graphic display means 905 are shown in FIGS. 10 and 11. FIG. 10 shows a display containing primarily a perspective view 1001 of a listening situation. On this view a typical listener 1002 and an image trajectory 1003 are presented, along with a representation of a motion picture screen 1004 and perspective space cues 1005, 1006.

At the bottom of the display is a menu 1007 of items relating to the particular section of sound track being operated upon, including recording, time synchronisation, and editing information. For example, menu items may allow locking of particular points on a trajectory to particular time codes, allowing synchronisation with picture effects. Menu items may be selected from the keyboard 907, or by moving cursor 1008 to the item, using multi-axis control 906. The selected item can be modified using keyboard 907, or toggled using a button on multi-axis control 906, invoking appropriate system action. In particular, a menu item 1009 allows an operator to link the multi-axis control 906 by software to control the viewpoint from which the perspective view is projected, or to control the position/trajectory of the current sound image. Another menu item 1010 allows selection of an alternate display illustrated in FIG. 11.

In the display illustrated in FIG. 11 the virtually full-screen perspective presentation 1001 shown in FIG. 10 is replaced by a set of three orthogonal views of the same scene; a top view 1101, a front view 1102, and a side view 1103. These views are similar to the views used in engineering drawing to represent three-dimensional parts, and may assist an operator in defining a position or trajectory more precisely. To aid in interpretation the remaining screen quadrant is occupied by a reduced and less detailed version 1104 of the perspective view 1001. Again a menu 1105, substantially similar to that shown at 1007 and with similar functions, occupies the bottom of the screen. One particular menu item 1106 allows toggling back to the display of FIG. 10.

Pursuant to economical use of the present invention, one or more human interfaces consisting of items equivalent to 905, 906 and 907 with suitable computing and storage facilities may be provided separately from the mixing console, and possibly with no direct link to any signal processing equipment. Such facilities would allow detailed preplanning of an editing and imaging session without tying up expensive studio facilities. Data from this isolated system might be transferred to the complete system by any of the many methods conventional to computer engineering. Hence a mixing operator may take advantage of pre-planning by others to simplify and speed the audio postprocessing task. Ideally, only fine tuning would remain to be executed.

These sample displays by no means exhaust the range of what may be provided, but stand as illustrations. For each specialised situation, a specialised display may show advantage. In matching a sound image to rapid visual action on a videotape or motion picture, for example, a "stop frame" display with a controllable cursor would allow precise manual superimposition of the cursor on an item whose trajectory corresponded to the required trajectory of the sound image. Control information derived could be stored, then be replayed at full speed to control the sound imaging process, perhaps locked to time codes previously displayed on a frame-by-frame basis. Automatic tracking, or semi-automatic tracking with computer "in-betweening" of key frames, might also be provided. These techniques may be implemented using computer technology, much of which exists in the prior art.

Figure 12:
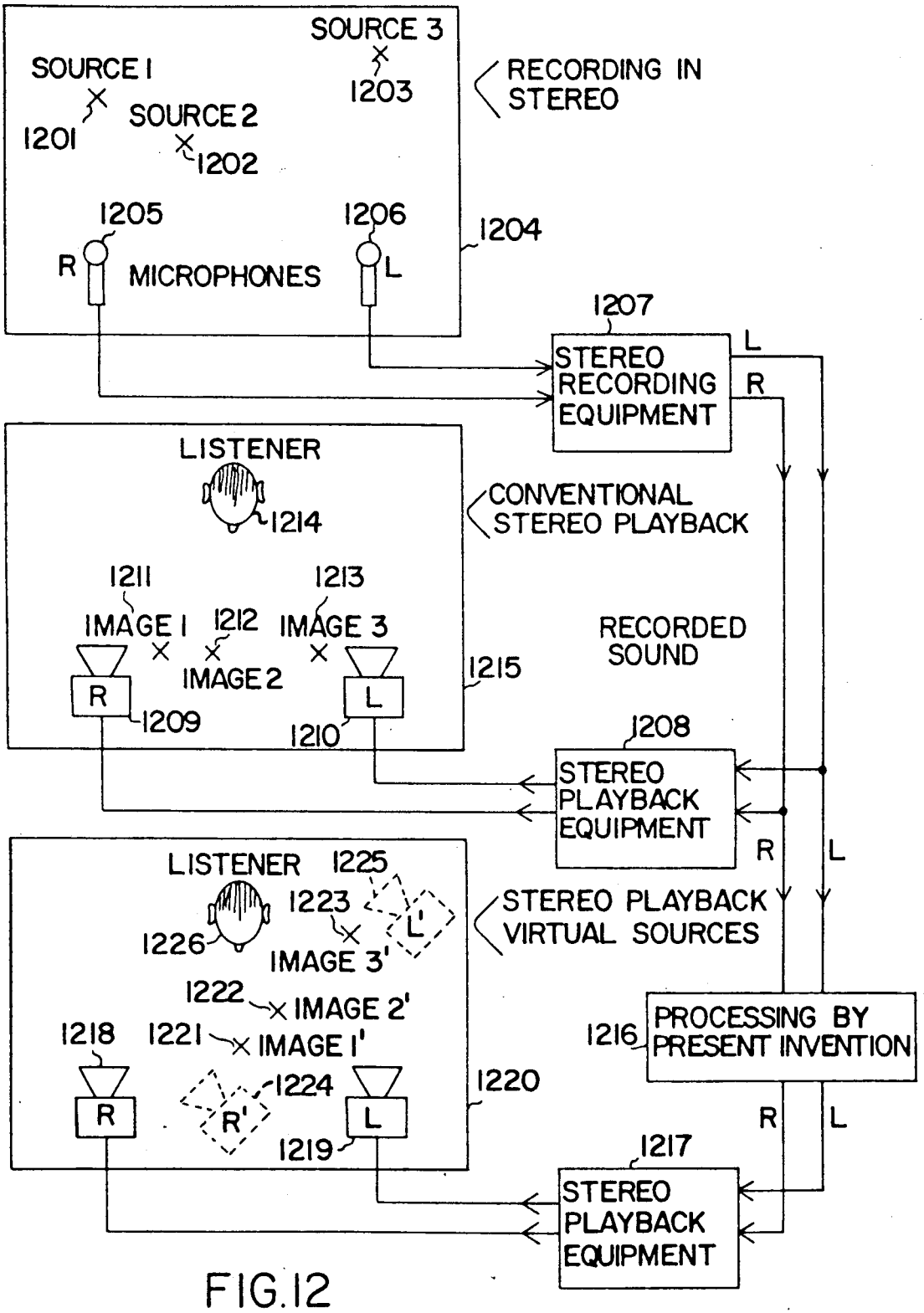
FIG. 12 illustrates the formation of virtual sound sources by the present invention, showing a plan view of three isolated rooms.

All of the above description has been couched in terms of the processing of truly monophonic signals, which contain no inherent information about the locality of a sound source. This is not a restriction on the process, and the result of applying the process to conventional stereo signals is both interesting and useful. Referring to FIG. 12, we may generate conventional stereo signals which partially represent the positions of three sound sources 1201, 1202, and 1203 in a first room 1204 by the usual technique of using two microphones 1205 and 1206 to generate right and left stereo signals respectively. These signals may be recorded using conventional stereo recording equipment 1207. If they are replayed on conventional stereo replay equipment 1208, driving right and left loudspeakers 1209, 1210 respectively with the signals originating from microphones 1205, 1206, conventional stereo images 1211, 1212, 1213 corresponding respectively to sources 1201, 1202, 1203 will be perceived by a listener 1214 in a second room 1215. These images will be at positions which are projections onto the line joining loudspeakers 1209, 1210 of the lateral positions of the sources relative to microphones 1205, 1206. All of this is familiar prior art.

If we now take the left and right stereo signals, which clearly contain information relating to the original source positions, we may treat each independently as if it were a monophonic signal and process it using the present invention. In this processing, we may project the images of the signals originating as right and left channel stereo to two different positions. Resulting from this process will be two pairs of right and left stereo signals, each pair containing information which will produce an image upon reproduction. One image will be of a "sound source" which would correspond to the right loudspeaker in conventional stereo, and the other to the left loudspeaker.

If the two pairs of stereo signals are processed and combined as detailed above using equipment 1216, and reproduced by conventional stereo equipment 1217 on right and left loudspeakers 1218, 1219 in a third room 1220, crisp spatially localised images of the sound sources corresponding to the conventional stereo loudspeakers may be formed at positions unrelated to the real loudspeaker positions. Let us suppose that the processing was such as to form an image of the original right channel signal at position 1224, and an image of the original left channel signal at 1225. Each of these images behaves as if it were truly a loudspeaker; we may think of the images as "virtual loudspeakers", following standard computer science terminology.

The sounds emitted from the virtual loudspeakers being substantially undistorted replicas of the right and left channels of conventional stereo sound, they still contain the partial position information relating to the original sources. Accordingly, a set of conventional stereo images 1221, 1222, 1223 corresponding respectively to sources 1201, 1202, 1203 are perceived by listener 1226. These images, as expected of conventional stereo images, are on the line joining the loudspeakers that generate them. In this case, that is the line joining the "virtual loudspeakers" 1224, 1225, which are in turn images formed by the real loudspeakers 1218, 1219.

Thus although the images formed by the present invention are illusory, in the sense that the sound field which results in their perception does not objectively resemble the sound field due to a real sound source at the image position, yet the illusion is sufficiently powerful to support a secondary illusion. The secondary illusion can in itself contain secondary sound image information based on a different process, conventional stereophonic sound.

A transfer function in which both amplitude and phase are functions of frequency across the entire audio band is required to project an image of a general signal to a given position. To specify each such response, amplitude and phase at intervals not exceeding 40 Hz, must be specified independently, for best image stability and coherence. Hence specification of such a response requires about 1000 real numbers (or equivalently, 500 complex ones). Difference limens for human perception of auditory spatial location are somewhat indefinite, being based on subjective measurement, but in a true three-dimensional space more than 1000 distinct positions are resolvable by an average listener. Exhaustive characterisation of all responses for all possible positions therefore constitutes a vast body of data, comprising in all more than one million real numbers, the collection of which is in progress.

In practice we need not represent all responses explicitly, as a mirror-image symmetry exists between the right and left channels. If the responses modifying the channels are interchanged, the image azimuth angle (a) is inverted, that is to say multiplied by $-1$, whilst the altitude (b) and range (r) remain unchanged. Thus it suffices to specify only those responses corresponding to (say) positive values of (a), and the responses for negative (a) may then be derived trivially.

With the responses known, special equipment as described in this document is still needed to apply them in real time to audio signals. Fortunately, it is possible to demonstrate the process and the illusion using conventional equipment well known in the prior art, by using simplified signals. If a burst of a sine wave at a known frequency is gated smoothly on and off at relatively long intervals, a very narrow band of the frequency domain is occupied by the resulting signal. Effectively, this signal will sample the required response at a single frequency. Hence the required responses reduce to simple control of amplitude and phase (or delay) for each of the left and right channels. By Fourier's theorem any signal may be represented as the sum of a series of sine waves, so the signal used is completely general.

Figure 13:
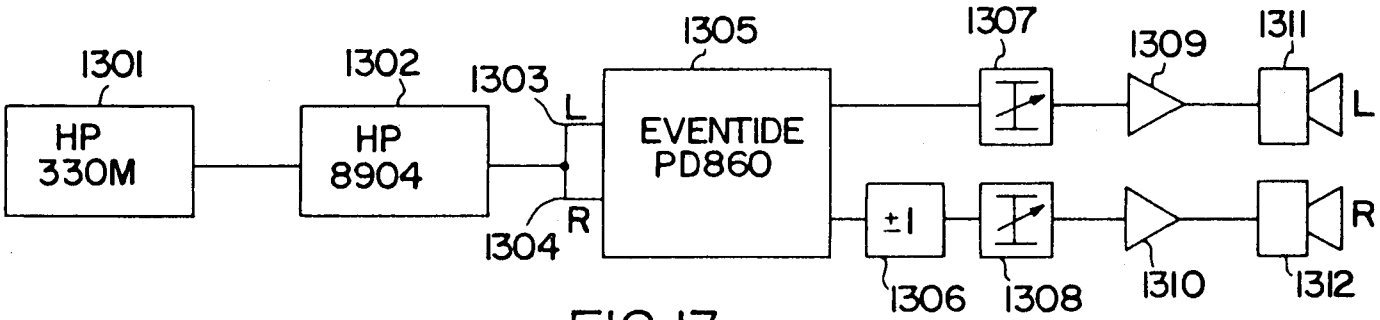
FIG. 13 shows equipment to demonstrate the present invention.

The requirements for a complete demonstration are thus reduced to a suitable signal generator, two attenuators, two controllable audio delays, and two reproduction channels comprising audio amplifiers and loudspeakers. FIG. 13 details a suitable equipment. Here a Hewlett-Packard Multifunction synthesiser model 8904A shown as item 1302 is controlled by a Hewlett-packard Computer model 330M shown as item 1301, to generate the signal. The signal thus generated is led to the inputs 1303, 1304 of two channels of an audio delay line, Eventide Precision Delay model pD860, shown as item 1303. From the delay the right signal passes to a switchable inverter 1306. Left and right signals then pass to two variable attenuators 1307, 1308 and hence to two power amplifiers 1309, 1310 driving left and right loudspeakers 1311, 1312. This description of equipment is in no way limiting, but is exemplary of a demonstration setup using readily available and conventional audio equipment.

Figure 14:
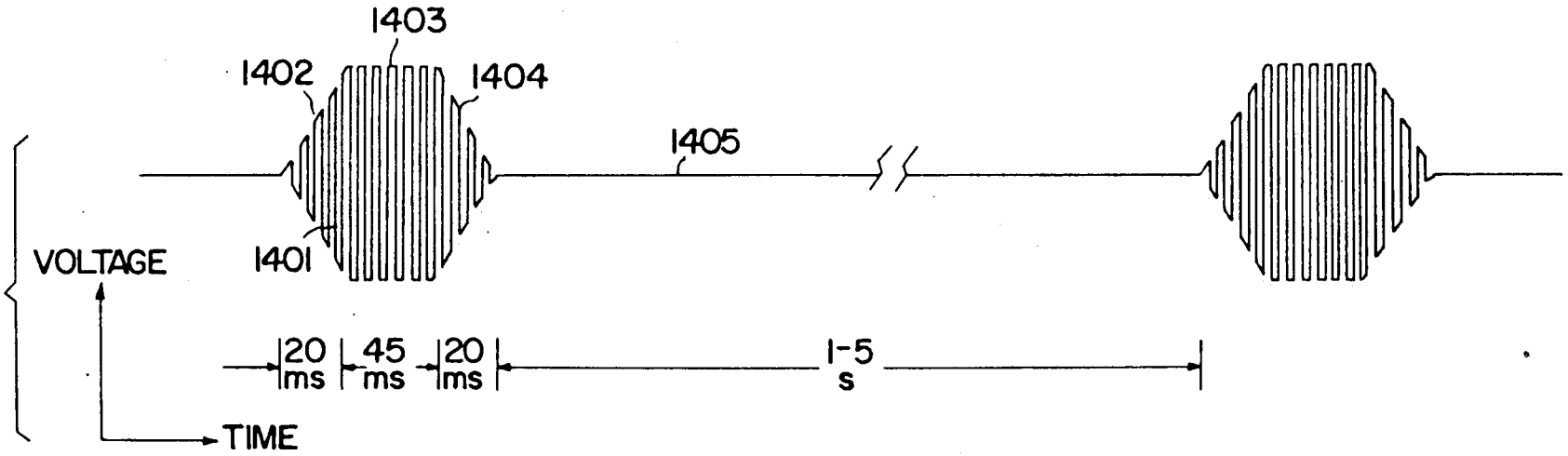
FIG. 14 is a graph of voltage against time for a test signal.

Referring to FIG. 14, the synthesiser is set to produce smoothly gated sine wave bursts of any desired test frequency 1401, using an envelope as illustrated. The sine wave is gated on using a first linear ramp 1402 of 20 ms duration, dwells at constant amplitude 1403 for 45 ms, and is then gated off using a second linear ramp 1404 of 20 ms duration. Bursts are repeated at intervals 1405 from about 1-5 seconds.

In the table of FIG. 15 practical data are given to allow reproduction of illusory images well off the direction of the loudspeakers, and well above the plane of the loudspeakers, for several sine wave frequencies. All of these images are stable and repeatable in all three listening rooms detailed in FIG. 5*m*, for a broad range of listener head attitudes including directly facing the image, and for a variety of listeners. All images are projected to a remote range, and will thus normally appear at a range limited by the walls of the listening space, as detailed above. The given data have been tested using the equipment of FIG. 13, and the signal of FIG. 14. Any equipment capable of similar performance will produce similar results.

In this demonstration three leading characteristics of the present process are clearly illustrated. Firstly, there can be no reverberant effect, since there is no feedback path around the delay element. Secondly, there is no cross-coupling of channels. Thirdly, the source elevation effect cannot be due to "pinna cues" as described by Bloom (cited above), since a broadband signal is required to "illuminate" the notch filter response used by Bloom, in such a way as to render it perceptible. The extremely narrowband signals used here would not suffice for this purpose. In any case, no notch filter is present in the demonstration equipment.

We may generalise the placement of narrowband signals, detailed above, in such a manner as to permit broadband signals, representing complicated sources such as speech and music, to be imaged. If the amplitudes and delays for both channels are specified for all frequencies throughout the audio band, the complete transfer function is specified. In practice, we need only explicitly specify the amplitudes and delays for a number of frequencies in the band of interest. Amplitudes and delays at any intermediate frequency, between those specified, may then be found as required by interpolation. If the frequencies at which the response is specified are not too widely spaced, taking into account the smoothness or rate of change of the true response represented, the method of interpolation is not critical since all reasonable methods will yield closely similar results.

In the table of FIG. 15, the amplitudes and delays applied to each channel by a specific equipment are documented explicitly. We may abbreviate this notation by taking advantage of two facts.

Firstly, only the difference between the delays is of interest. Suppose that the left and right channel delays are t(1) and t(r) respectively. We are free to define new delays t,(1) and t,(r) by adding any fixed delay t(a) such that:

$$t'(1)=t(1)+t(a) \quad 1$$

$$t'(r)=t(r)+t(a) \quad 2$$

The effect is merely that the entire effect is heard a time t(a) later, or earlier in the case where t(a) is negative. This general case holds in the special case where $t(a)=-t(r)$. Substituting:

$$t'(1)=t(1)-t(r) \quad 3$$

$$t'(r)=t(r)-t(r)=0 \quad 4$$

By this transformation we may always reduce the delay in one channel to zero. In a practical implementation we must be careful to subtract out the smaller delay, so that the need for a negative delay never arises. It may be preferred to avoid this problem by leaving a fixed residual delay in one channel, and changing the delay in the other. If the fixed residual delay is of sufficient magnitude, the variable delay need not be negative.

Secondly, we need not control channel amplitudes independently. It is a common operation in audio engineering to change the amplitudes of signals by amplification or attenuation. So long as both stereo channels are changed by the same ratio, there is no change in the positional information carried. It is the ratio of amplitudes which is important, and must be preserved. So long as this ratio is preserved, all of the effects and illusions in this description are entirely independent of the overall sound level of reproduction. Accordingly, by an operation similar to that detailed above for timing, we may place all of the amplitude control in one channel, leaving the other at a fixed amplitude. Again, it may be convenient to apply a fixed residual attenuation to one channel, so that all required ratios are attainable by attenuation of the other. Full control is then available using a variable attenuator in one channel only.

We may thus specify all the required information by specifying the attenuation and delay as functions of frequency for a single channel. A fixed, frequency-independent attenuation and delay may be specified for the second channel; if these are left unspecified, we assume unity gain and zero delay.

Several equivalent representations of this information are possible, and are commonly used in related arts. For example, the delay may be specified as a phase change at any given frequency, using the equivalences:

$$\text{Phase(degrees)}=360\times(\text{delay time})\times\text{frequency}$$

$$\text{Phase(radians)}=2\times\pi\times(\text{delay time})\times\text{frequency}$$

Hence a specification of phase against frequency is trivially equivalent to a specification of delay against frequency. We must exercise caution in applying this equivalence, since it is not sufficient to specify the principal value of phase; the full phase is required if the above equivalences are to hold.

A convenient representation commonly used in electronic engineering is the complex s-plane representation. All filter characteristics realisable using real analog components (and many that are not) may be specified as a ratio of two polynomials in the Laplace complex frequency variable s. The general form is:

$$T(s)=\frac{Ein(s)}{Eout(s)}=\frac{N(s)}{D(s)} \quad 5$$

Where T(s) is the transfer function in the s plane, Ein(s) and Eout(s) are the input and output signals respectively as functions of s, and the Numerator and Denominator functions N(s) and D(s) are of the form:

$$N(s)=a_o+a_1s+a_2s^2+a_3s^3+\ldots+a_ns^n \quad 6$$

$$D(s)=b_o+b_1s+b_2s^2+b_3s^3+\ldots+b_ns^n \quad 7$$

The attraction of this notation is that it may be very compact. To specify the function completely at all frequencies, without need of interpolation, we need only specify the n+1 coefficients a and the m+1 coefficients b. With these coefficients specified the amplitude and phase of the transfer function at any frequency may readily be derived using well-known methods. A further attraction of this notation is that it is the form most readily derived from analysis of an analog circuit, and therefore stands as the most natural, compact, and well-accepted method of specifying the transfer function of such a circuit.

Yet another representation convenient for use in describing the present invention is the z-plane representation. In the preferred embodiment of the present invention, the signal processor will be implemented as digital filters in order to obtain the advantage of flexibility. Since each image position may be defined by a transfer function, we need a form of filter in which the transfer function may be readily and rapidly realised with a minimum of restrictions as to which functions may be achieved. A fully programmable digital filter is appropriate to meet this requirement.

Such a digital filter may operate in the frequency domain. In this case, the signal is first Fourier transformed to move it from a time domain representation to a frequency domain one. The filter amplitude and phase response, determined by one of the above methods, is then applied to the frequency domain representation of the signal by complex mutiplication. Finally, an inverse Fourier transform is applied, bringing the signal back to the time domain for digital to analog conversion.

Alternatively, we may specify the response directly in the time domain as a real impulse response. This response is mathematically equivalent to the frequency domain amplitude and phase response, and may be obtained from it by application of an inverse Fourier transform. We may apply this impulse response directly in the time domain by convolving it with the time domain representation of the signal. It may be demonstrated that the operation of convolution in the time domain is mathematically identical with the operation of multiplication in the frequency domain, so that the direct convolution is entirely equivalent to the frequency domain operation detailed in the preceeding paragraph. The choice of method to use is dominated by considerations of computational efficiency; neither method has a clear universal advantage, but in any given case one may show performance many times better than the other.

Since all digital computations are discrete rather than continuous, a discrete notation is preferred to a continuous one. It is convenient to specify the response directly in terms of the coefficients which will be applied in a recursive direct convolution digital filter, and this is readily done using a z-plane notation which parallels the s-plane notation. Thus if T(z) is a time domain response equivalent to T(s) in the frequency domain, we may write:

$$T(z)=\frac{N(z)}{D(z)} \quad 8$$

Where N(z) and D(z) have the form:

$$N(z)=c_o+c_1z^{-1}+c_2z^{-2}+\ldots+c_nz^{-n} \quad 9$$

$$D(z)=d_o+d_1z^{-1}+d_2z^{-2}+\ldots+d_mz^{-m} \quad 10$$

In this notation the coefficients c and d suffice to specify the function as the a and b coefficients did in the s-plane, so equal compactness is possible. The z-plane filter may be implemented directly if the operator z is interpreted such that $z^{-1}$ is a delay of n sampling intervals.

Then the specifying coefficients c and d are directly the multiplying coefficients in the implementation. We must restrict the specification to use only negative powers of z, since these correspond to positive delays. A positive power of z would correspond to a negative delay, that is a response before a stimulus was applied.

With these notations in hand we may describe equipment to allow placement of images of broadband sounds such as speech and music. For these purposes the signal processor of the present invention may be embodied as a variable two-path analog filter with variable path coupling attenuators. This embodiment is shown in schematic form in FIG. 16. The entire filter may be regarded as exemplary of signal processor 802 in FIG. 8.

Figure 16A:
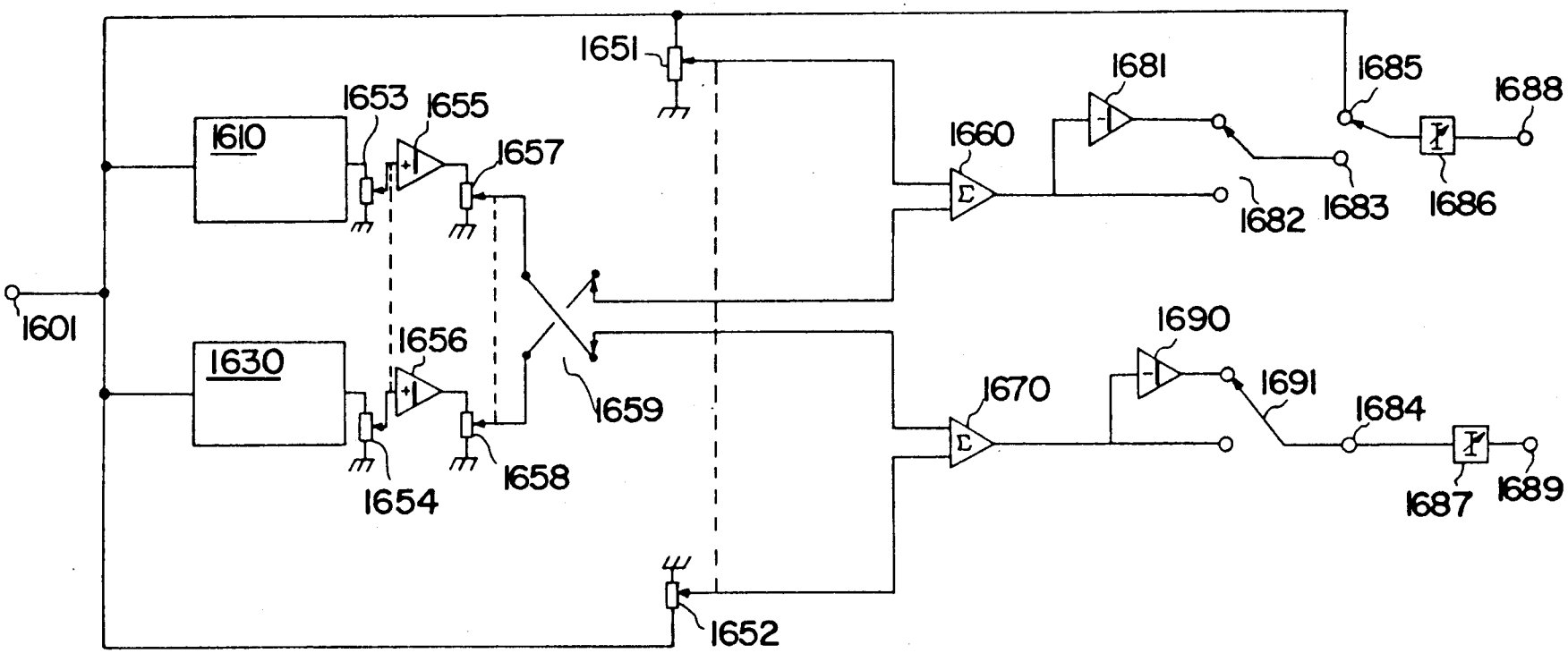
-FIGS. 16*a*–16*d* are schematic block diagrams of a circuit embodying the present invention.

Referring to FIG. 16*a*, a monophonic input signal 1601 is led to the inputs of two filters 1610, 1630, and two potentiometers 1651, 1652. Outputs from the filters are led to two potentiometers 1653, 1654. The four potentiometers are arranged on a joystick control such that they act differentially. One joystick axis allows control of potentiometers 1651, 1652; as one moves such as to pass a greater proportion of its input to its output, the other is mechanically reversed and passes a smaller proportion of its input to its output. Similarly, potentiometers 1653, 1654 are differentially operated by a second, independent joystick axis. Output signals from potentiometers 1653, 1654 are passed to unity gain buffers 1655, 1656 respectively, which in turn drive potentiometers 1657, 1658 respectively. These potentiometers are coupled to act together; they increase or decrease the proportion of input passed to the output in step. From the potentiometers signals pass to the reversing switch 659, which allows the filter signals to be led, directly or interchanged, to first inputs of the summing elements 1660, 1670.

Each summing element receives at its second input an output from potentiometers 1651, 1652 respectively. Summing element 1670 drives inverter 1690, and switch 691 allows selection of the direct or inverted signal to drive input 1684 of attenuator 1689. The output of attenuator 1689 is the right channel stereo signal. Similarly summing element 1660 drives inverter 1681, and switch 1682 allows selection of the direct or inverted signal at point 1683. Switch 1685 allows selection of the signal 1683 or the input signal 1601 as the drive to attenuator 1686 which produces left channel output 1688.

Figure 16B:
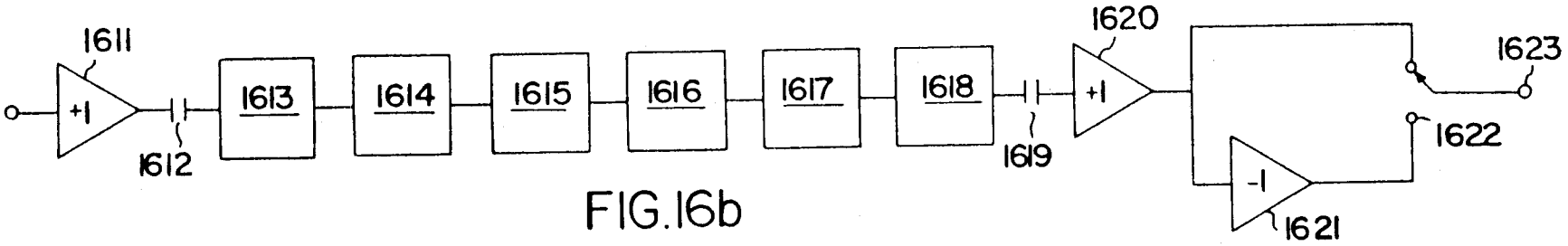

Filters 1610, 1630 are identical, and their internal structure is shown in FIG. 16*b*. Here unity gain buffer 1611 accepts the input signal, and is capacitively coupled via capacitor 1612 to drive filter element 1613. Similar elements 1614 to 1618 are cascaded, and final element 1618 is coupled via capacitor 1619 and unity gain buffer 1620 to drive inverter 1621. Switch 1622 allows selection of either the output of buffer 1620, or of inverter 1621, to drive the filter output 1623.

Figure 16D:
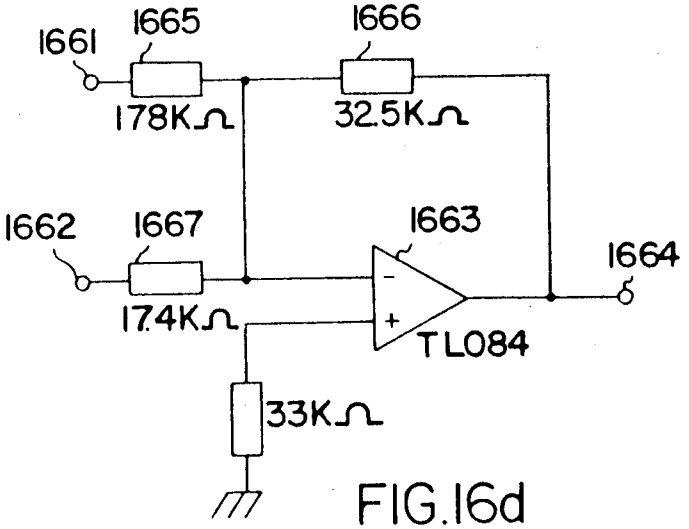
Figure 16C:
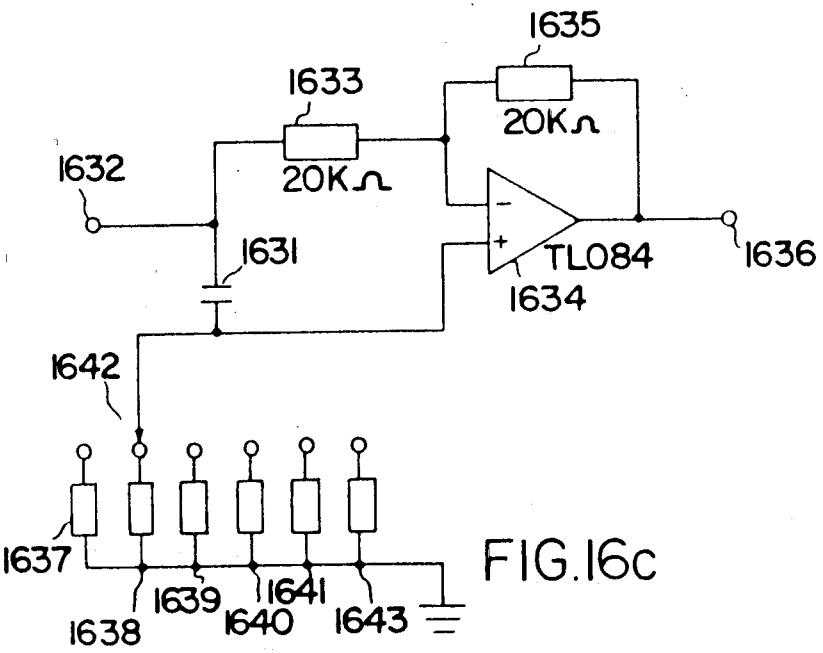

Filter elements 1613 through 1618 are of identical topography, as shown in FIG. 16*c*. They differ in the value of capacitor 1631. Input 1632 drives capacitor 1631 and resistor 1633. Resistor 1633 is coupled to the inverting input of operational amplifier 1634, whose output 1636 is the element output, and also drives feedback resistor 1635. The non-inverting input of operational amplifier 1634 is driven from the junction of capacitor 1631 and a resistor 1637 to 1641 and 1643 selected by switch 1642. This structure is an all-pass filter with a phase shift which varies with frequency according to the setting of switch 1642. Table 1 lists the values of capacitor 1631 used in each element. Table 2 lists the resistor values selected by switch 1642; these resistor values are the same for all elements.

Finally, referring to FIG. 16*d*, the internal structure of the identical summing elements 1660, 1670 is shown. These are conventional operational amplifier summers accepting two inputs 1661, 1662 and summing with operational amplifier 1663 to give a single output 1664. The gains from input to output are determined by the summing resistors 1665, 1667 and feedback resistor 1666. In both cases input 1662 is driven from switch 1659, and input 1661 from joystick potentiometers 1651, 1652 respectively.

In this embodiment the amplitude and phase characteristics of the filter may be varied within the limitations of the equipment by the switches, the dual potentiometer, and the joystick. Hence a flexible means of introducing the required differences between the two channels is provided. By the use of these controls, transfer functions adequate for the placement of a range of broadband signals may rapidly be realised.

As examples of such placement Table 3 shows settings and corresponding image positions to "fly" a sound image corresponding to a helicopter at positions well above the plane including the loudspeakers and the listener. In these examples the basic monophonic helicopter sound effect was taken from a sound effects library compact disc, published by Sound Ideas as disc #2013. The first ten seconds of track 08-01, which is an approach and landing by a Bell "Ranger" jet helicopter, are imaged to two possible consecutive approach positions. To obtain the required monophonic signal for the process of the present invention, the stereo tracks on the disc were summed. With the equipment shown set up as tabulated, realistic sound images are projected in space in such a manner that the listener perceives a helicopter at the locations tabulated. Helicopters create a strongly patterned sound with considerable energy across the entire audio band, so that the production of a coherent image of such a sound requires that every frequency be projected to the same location. This is more exacting than placement of an image of a musical instrument such as a flute, in which only a fundamental frequency and a few low harmonics contain all of the significant energy.

TABLE 1

| Filter # | 1 | 2 | 3 | 4 | 5 | 6 |
|---|---|---|---|---|---|---|
| Capacitor 1631 Value, nF | 100 | 47 | 33 | 15 | 10 | 4.7 |

TABLE 2

| Switch 1642 Position # | 1 | 2 | 3 | 4 | 5 |
|---|---|---|---|---|---|
| Resistor # | 1637 | 1638 | 1639 | 1640 | 1641 |
| Resistor value, Ohms | 4700 | 1000 | 470 | 390 | 120 |

TABLE 3

| | | |
|---|---|---|
| Filter 1630 element 1 switch pos. | 5 | 5 |
| Filter 1630 element 2 switch pos. | 5 | 5 |
| Filter 1630 element 3 switch pos. | 5 | 5 |
| Filter 1630 element 4 switch pos. | 5 | 5 |
| Filter 1630 element 5 switch pos. | 5 | 5 |
| Filter 1630 inverting switch 1622 | norm. | norm. |
| Potentiometer 1652 ratio | 0.046 | 0.054 |
| Potentiometer 1654 ratio | 0.90 | 0.76 |
| Potentiometer 1658 ratio | 0.77 | 0.77 |
| Inverting switch 1691 position | inv. | inv. |
| Selector switch 1685 position | 1601 | 1601 |
| Output attenuator 1686 ratio | 0.23 | 0.23 |
| Output attenuator 1687 ration | 1.0 | 1.0 |
| Image azimuth a, degrees | −45 | −30 |
| Imate altitude b, degrees | +21 | −17 |
| Image range r | remote | remote |

Note to table 3: setting of reversing switch 1659 in both cases is such that signals from element 1657 drive element 1660, and those from element 1658 drive element 1670.

Figure 17:
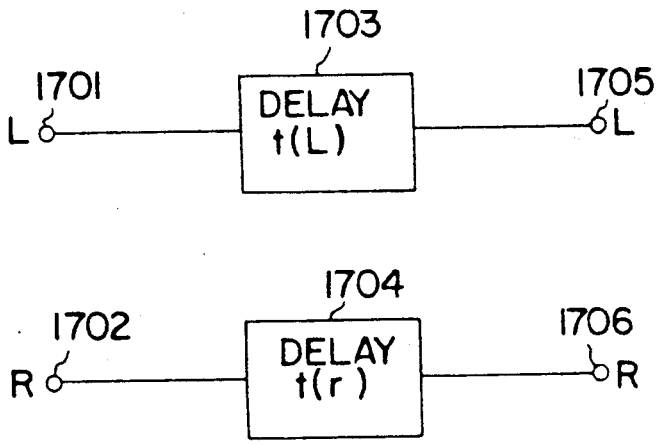
FIG. 17 is a schematic block diagram of additional circuitry which further embodies the present invention.

By addition of two extra elements to the equipment described above, we may produce an extra facility for lateral shifting of the listening area. It should be understood that this is not essential to the creation of images. The extra elements are shown in FIG. 17. Here left and right signals 1701, 1702 may be supplied from the outputs 1688, 1689 respectively of the signal processor shown in FIG. 16. In each channel a delay 1703, 1704 respectively is inserted. Output signals from the delays 1705, 1706 now become the processor outputs.

The delays introduced into the channels by this additional equipment are independent of frequency. They may thus each be completely characterised by a single real number. Let the left channel delay be t(1), and the right channel delay t(r). As in the above case, only the difference between the delays is significant, and we can completely control the equipment by specifying the difference between the delays. In implementation, we will add a fixed delay to each channel to ensure that at least no negative delay is required to achieve the required difference. Let us now define a difference delay t(d) as:

$$t(d)=t(r)-t(1) \qquad 11$$

Now if t(d) is zero the effects produced will be essentially unaffected by the additional equipment. If t(d) is positive, the centre of the listening area will be displaced laterally to the right along dimension (e) as shown in FIG. 3. A positive value of t(d) will correspond to a positive value of (e), signifying rightward displacement. Similarly, a leftward displacement, corresponding to a negative value of (e), may be obtained by a negative value of t(d). By this method the entire listening area, in which listeners perceive the illusion, may be projected laterally to any point between or beyond the loudspeakers. It is readily possible for dimension (e) to exceed half of dimension (s), and good results have been obtained out to extreme shifts at which dimension (e) is 83% of dimension (s). This may not be the limit of the technique, but represents the limit of current experimentation.

In describing the process, reference has been made in particular to a sound postprocessing environment in which it might operate to advantage. Use of the process is by no means limited to such an environment, particularly if real-time image processing is provided. In a sound reinforcement or public address system, the process might be utilised to place a sound image of substantial power at the position of an orator. If the orator position is fixed, as by provision of a rostrum with attached microphones, a fixed image position would be satisfactory and neither operator nor human interface would be required. Where sound amplification is to be provided for a more spatially dynamic performance, an operator might track the sound image to match the position(s) of one or more performers, or might achieve artistic effects by manipulation of image position without reference to performer positions. Application of the process confers a new freedom on those responsible for any form of sound reproduction, either immediate or recorded. Undoubtedly this new freedom will allow novel and pleasurable effects to be attained, which were previously beyond the scope of the auditory arts.

The invention described above is, of course, susceptible to many variations, modifications and changes, all of which are within the skill of the art. It should be understood that all such variations, modifications and changes are within the spirit and scope of the invention and of the appended claims. Similarly, it will be understood that it is intended to cover all changes, modifications and variations of the example of the invention herein disclosed for the purpose of illustration which do not constitute departures from the spirit and scope of the invention.

We claim:

1. A method for producing an locating an origin of a selected sound in a predetermined position within the three-dimensional space containing a listener from an electrical signal corresponding to the selected sound, comprising the steps of:

separating said electrical signal into respective first and second channel signals;

altering the amplitude and shifting the phase of said signals in at least one of said first and second channels, both on a predetermined frequency dependent basis, thereby producing at least a first or a second channel modified signal; and respectively applying said first and second channel signals including said modified signal to first and second sound transducer means located within the three-dimensional space and spaced apart from the listener to produce a sound originating at a predetermined location in the three-dimensional space different than the location of said sound transducer means; further including the step of applying at least one of said signals in first and second signal channels to at least one all pass filter containing an operational amplifier portion, said filter having a predetermined frequency response and topology as characterized by a transfer function T(s) for the Laplace complex frequency variable s of the form $$T(s)=[1-(1/R_1)(R_1+R_2)/(1+sCR_3)]$$

where $R_1$ and $R_2$ represent the input and feedback impedances, respectively connected to the inverting input of the operational amplifier section of the filter, while c and $R_3$ represent the input and ground elements connected to the noninverting input of the operational amplifier section; or equivalent means of obtaining a transfer function equivalent to that of T(s) defined above.

2. A method for producing and locating an origin of at least one selected sound in a predetermined and localized position located anywhere within the three-dimensional space containing a listener from an electrical signal corresponding thereto and representative thereof, comprising the steps of:

separating said electrical signal for each selected sound into respective first and second channel signals;

altering the amplitude and shifting the phase of at least one of said first and second channel signals, both on a frequency dependent basis, in successive frequency intervals within the audio spectrum, thereby producing at least a respective first or a second channel modified signal for said first and second channel signals;

respectively applying to first and second sound transducer means located within the three-dimensional space containing the listener and spaced apart from the listener one of said first and second channel signals and at least one of said first and second channel modified signals to produce a sound originating at a location in the three-dimensional space different from the location of either of said sound transducer means; and further including the step of:

applying at least one of said first and second channel signals to a cascaded series of filters, at least one of said filters comprising an all pass filter containing an operational amplifier portion, said filter containing an operational amplifier portion, said filter having a predetermined frequency response and topology as characterized by a transfer function T(s) for the Laplace complex frequency variable s of the form $$T(s)=[1-(1/R_1)(R_1+R_2)/(1+sCR_3)]$$

where $R_1$ and $R_2$ represent the input and feedback impedances, respectively connected to the inverting input of the operational amplifier section of the filter, while c and $R_3$ represent the input and ground elements connected to the non-inverting input of the operational amplifier section; or equivalent means of obtaining a transfer function equivalent to that of T(s) defined above.

* * * * *